US010287056B2

(12) United States Patent
Wissner et al.

(10) Patent No.: US 10,287,056 B2
(45) Date of Patent: May 14, 2019

(54) HOLDING STRUCTURE FOR CONCURRENTLY HOLDING A PLURALITY OF CONTAINERS FOR SUBSTANCES FOR MEDICAL, PHARMACEUTICAL OR COSMETIC APPLICATIONS AS WELL AS TRANSPORT OR PACKAGING CONTAINER COMPRISING THE SAME

(71) Applicant: SCHOTT AG, Mainz (DE)

(72) Inventors: Kai Wissner, Hirschberg (DE); Gregor Fritz Deutschle, Wiesbaden (DE); Kristopher Koch, Lebanon, PA (US)

(73) Assignee: SCHOTT AG, Mainz (DE)

( * ) Notice: Subject to any disclaimer, the term of this patent is extended or adjusted under 35 U.S.C. 154(b) by 64 days.

(21) Appl. No.: 15/205,119

(22) Filed: Jul. 8, 2016

(65) Prior Publication Data

US 2016/0318660 A1 Nov. 3, 2016

Related U.S. Application Data

(60) Division of application No. 14/594,819, filed on Jan. 12, 2015, which is a continuation of application No. PCT/EP2013/059297, filed on May 3, 2013.

(Continued)

(30) Foreign Application Priority Data

Jul. 13, 2012 (DE) ..... 10 2012 106 341
Sep. 4, 2012 (DE) ..... 10 2012 108 215
Nov. 5, 2012 (DE) ..... 10 2012 110 547

(51) Int. Cl.
*B65D 25/10* (2006.01)
*B65B 21/18* (2006.01)

(Continued)

(52) U.S. Cl.
CPC ..... *B65D 25/108* (2013.01); *A61J 1/16* (2013.01); *A61J 7/0069* (2013.01);

(Continued)

(58) Field of Classification Search
CPC ..... B65D 1/36; B65D 71/50; B65D 25/108; B65D 25/10; A61J 1/16; A61J 7/0069; B01L 9/06

(Continued)

(56) References Cited

U.S. PATENT DOCUMENTS 2,140,314 A 12/1938 Döscher
2,575,294 A * 11/1951 Putorak ..... A21B 3/13 220/23.4

(Continued)

FOREIGN PATENT DOCUMENTS

CH 343881 12/1959
CN 1238061 12/1999

(Continued)

OTHER PUBLICATIONS

English Translation of the International Search Report dated Sep. 2, 2013 for corresponding International Application No. PCT/EP2013/059297.

(Continued)

*Primary Examiner* — Steven A. Reynolds
(74) *Attorney, Agent, or Firm* — Ohlandt, Greeley, Ruggiero & Perle, L.L.P.

(57) ABSTRACT

A holding structure for concurrently holding a plurality of containers for substances for cosmetic, medical or pharmaceutical applications, in particular of vials, is provided. The holder includes a carrier having a plurality of apertures or receptacles into which the containers can be inserted, and holding tabs for holding the containers in the apertures or receptacles. The holding tabs are at least two holding tabs, (Continued)

which are provided at the edge of a respective aperture or receptacle and protrude from an upper side of the carrier for holding the respective container. The holding tabs are resiliently pivoted or folded back as the containers are inserted into the apertures or receptacles. The holding tabs are matched to the containers such that the containers are held by the holding tabs with a radial clearance and low tension.

26 Claims, 21 Drawing Sheets

Related U.S. Application Data

(60) Provisional application No. 61/696,457, filed on Sep. 4, 2012.

(51) Int. Cl.

| | |
|---|---|
| ***F26B 5/06*** | (2006.01) |
| ***F26B 25/00*** | (2006.01) |
| ***A61J 1/16*** | (2006.01) |
| ***A61J 7/00*** | (2006.01) |
| ***B65D 71/50*** | (2006.01) |
| ***B65D 1/36*** | (2006.01) |
| ***B65B 7/28*** | (2006.01) |
| ***B65B 43/42*** | (2006.01) |
| *B65B 61/20* | (2006.01) |
| *B01L 9/06* | (2006.01) |
| *B65B 3/00* | (2006.01) |

(52) U.S. Cl.
CPC ..... *B65B 7/2892* (2013.01); *B65B 21/18* (2013.01); *B65B 43/42* (2013.01); *B65D 1/36* (2013.01); *B65D 71/50* (2013.01); *F26B 5/06* (2013.01); *F26B 25/001* (2013.01); *B01L 9/06* (2013.01); *B65B 3/003* (2013.01); *B65B 61/207* (2013.01)

(58) Field of Classification Search
USPC ..... 206/563, 562, 504, 364, 366, 370, 477, 206/478; 220/23.2, 23.4
See application file for complete search history.

(56) References Cited

U.S. PATENT DOCUMENTS

| | | | | |
|---|---|---|---|---|
| 3,131,829 | A | 5/1964 | Masser | |
| 3,243,049 | A | 3/1966 | Seligmann, Jr. et al. | |
| 3,537,189 | A | 11/1970 | Bender et al. | |
| 3,643,812 | A * | 2/1972 | Mander | B01L 9/06 206/443 |
| 4,040,234 | A | 8/1977 | Stockdale et al. | |
| 5,964,043 | A | 10/1999 | Oughton et al. | |
| 7,232,038 | B2 * | 6/2007 | Whitney | B01L 9/06 211/74 |
| 7,428,807 | B2 | 9/2008 | Bush | |
| 7,910,067 | B2 * | 3/2011 | Knight | B01L 9/06 211/71.01 |
| 8,087,527 | B2 * | 1/2012 | Johnson | B65D 81/3294 206/504 |
| 8,100,263 | B2 | 1/2012 | Vanderbush et al. | |
| 8,118,167 | B2 | 2/2012 | Togashi et al. | |
| 2001/0002984 | A1 | 6/2001 | Vetter | |
| 2001/0052476 | A1 | 12/2001 | Heinz et al. | |
| 2003/0141300 | A1 * | 7/2003 | French | B65D 21/0204 220/23.4 |
| 2005/0236346 | A1 | 10/2005 | Whitney | |
| 2006/0113303 | A1 | 6/2006 | Huruta | |
| 2007/0151882 | A1 * | 7/2007 | Cocheteux | A61M 5/008 206/366 |
| 2007/0272587 | A1 | 11/2007 | Nguyen et al. | |
| 2011/0226662 | A1 * | 9/2011 | Nicoletti | B65D 5/503 206/562 |
| 2011/0277419 | A1 | 11/2011 | Nicoletti | |
| 2012/0181285 | A1 | 7/2012 | Krauss et al. | |
| 2013/0048531 | A1 | 2/2013 | Nicoletti | |
| 2013/0161225 | A1 | 6/2013 | Lepot | |
| 2013/0186793 | A1 | 7/2013 | Gagnieux | |

FOREIGN PATENT DOCUMENTS

| | | | |
|---|---|---|---|
| CN | 1585713 | | 2/2005 |
| CN | 1852839 | | 10/2006 |
| CN | 201825307 | | 5/2011 |
| CN | 202054227 | | 11/2011 |
| CN | 102470207 | | 5/2012 |
| CN | 102530385 | | 7/2012 |
| CN | 202295369 | | 7/2012 |
| DE | 2658432 | | 7/1977 |
| DE | 3819095 | | 12/1989 |
| DE | 3908582 | | 9/1990 |
| DE | 10012575 | | 9/2001 |
| DE | 102007042218 | | 3/2009 |
| DE | 102009027452 | | 1/2011 |
| DE | 102009027454 | A1 | 1/2011 |
| EP | 0790063 | A1 | 8/1997 |
| EP | 1449551 | | 8/2004 |
| EP | 2119463 | | 11/2009 |
| GB | 295672 | | 8/1928 |
| GB | 590421 | | 7/1947 |
| KR | 20100004281 | | 4/2010 |
| WO | 03022685 | | 3/2003 |
| WO | 2009015862 | | 2/2009 |
| WO | 2010086128 | | 8/2010 |
| WO | 2011015896 | | 2/2011 |
| WO | 2011135085 | | 11/2011 |
| WO | 2014033766 | | 3/2014 |

OTHER PUBLICATIONS

Written Opinion of the International Searching Authority dated Sep. 2, 2013 for corresponding International Application No. PCT/EP2013/059297 with English Translation, 7 pages.

English Translation of the International Preliminary Report on Patentability dated Jan. 13, 2015 for corresponding International Application No. PCT/EP2013/059297, 6 pages.

International Search Report dated Oct. 17, 2013 for corresponding International Patent Application No. PCT/EP2013/059183 with English translation, 9 pages.

English translation of Written Opinion of the International Searching Authority dated Oct. 17, 2013 for corresponding International Patent Application No. PCT/EP2013/059183, 10 pages.

English translation of the International Preliminary Report on Patentability dated Nov. 4, 2014 for corresponding International Patent Application No. PCT/EP2013/059183, 11 pages.

Chinese Office Action dated Aug. 6, 2015 from corresponding Chinese Application No. 201380037486.X with English translation, 11 pages.

English translation of the Written Opinion of the International Search Authority dated Sep. 2, 2013 for corresponding International Application No. PCT/EP2013/059297, with certification attesting to the accuracy of the English translation of the Written Opinion, 8 pages.

* cited by examiner

A-A

HOLDING STRUCTURE FOR CONCURRENTLY HOLDING A PLURALITY OF CONTAINERS FOR SUBSTANCES FOR MEDICAL, PHARMACEUTICAL OR COSMETIC APPLICATIONS AS WELL AS TRANSPORT OR PACKAGING CONTAINER COMPRISING THE SAME

CROSS REFERENCE TO RELATED APPLICATIONS

This application is a divisional of U.S. application Ser. No. 14/594,819 filed on Jan. 12, 2015, which is a continuation of International Application No. PCT/EP2013/059297 filed on May 3, 2013, which claims the priority of German Patent application No. 10 2012 106 341.9 filed on Jul. 13, 2012, claims the priority of German Patent application No. 10 2012 108 215.4 filed on Sep. 4, 2012, claims the priority of German Patent application No. 10 2012 110 547.2 filed on Nov. 5, 2012, and claims the benefit of U.S. Application Ser. No. 61/696,457 filed on Sep. 4, 2012, the contents of all which are hereby incorporated in their entirety by way of reference.

BACKGROUND

1. Field of Invention

The present invention relates generally to the concurrent holding of a plurality of containers, which serve for storing substances for medical, pharmaceutical or cosmetic applications, in particular of vials, and relates in particular to the concurrent holding of a plurality of such containers in a holding structure in a simple and reliable manner and in such a manner that these can be processed or processed further in filling or processing facilities while being held in a holding structure provided for this purpose, particularly in a sterile tunnel, a filling facility for liquid medical or pharmaceutical applications or a freeze-dryer. Furthermore, the present invention relates to a transport and/or packaging container comprising such a holding structure and optionally an integrated sensor system and/or an anti-counterfeiting protection.

2. Description of Related Art

Medication containers, for example vials, ampoules or cartridges, are widely used as containers for preservation and storage of medical, pharmaceutical or cosmetic preparations to be administered in liquid form, in particular in pre-dosed amounts. These generally have a cylindrical shape, can be made of plastic or glass and are available in large quantities at low costs. In order to fill the containers under sterile conditions as efficiently as possible concepts are increasingly used according to which the containers are already packaged in a transport or packaging container at the manufacturer of the containers under sterile conditions, which are then unpackaged and further processed at a pharmaceutical company under sterile conditions, in particular in a so-called sterile tunnel.

For this purpose, various transport and packaging containers are known from the prior art, in which a plurality of medication containers are concurrently arranged in a regular arrangement, for example in a matrix arrangement along rows and columns extending perpendicular thereto. This has advantages in the automated further processing of the containers since the containers can be transferred to processing stations at controlled positions and in a predetermined arrangement, for example to processing machines, robots or the like. For this purpose, holding structures are used, in which a plurality of containers can be retained concurrently in a predetermined regular arrangement. For the transfer to a processing station it is just required to properly position and open the transport and packaging container. The downstream processing station will then know at what position and in what arrangement the containers to be processed further are arranged.

Such a transport and packaging container and a corresponding packaging concept are disclosed for example in U.S. Pat. No. 8,118,167 B2. The further processing of the containers is, however, always performed such that the holding structure will be removed from the transport and packaging container, that the containers will be removed from the holding structure and isolated and then individually placed on a conveyor, in particular a conveyor belt, and transferred to the processing stations for further processing. This limits the speed of processing that can be achieved. Particularly in the isolation of the containers by means of cell wheels or the like, it always occurs that individual containers abut uncontrolled, which results in an undesired abrasion and subsequently in a contamination of the interior volume of the containers or of the processing station and in an impairment of the outer appearance of the containers which is undesirable.

U.S. Pat. No. 8,100,263 B2 discloses a portable transport and packaging container that can be packaged in a sterile manner, in which a plate-shaped holding structure can be inserted in which a plurality of medication containers are held in a regular arrangement. Firstly, the individual medication containers are placed loosely in receptacles, which are formed in the holding structure. Then, the holding structure is placed in the transport and packaging container, which is then surrounded by a gas-impermeable plastic tube. Upon subsequent evacuation of the packaging unit thus formed, the plastic tube is pressed into the spaces between the medication containers due to the negative pressure prevailing in the tube, which, on the one hand, results in a stabilization of the positions of the medication containers in the holding structure and, on the other hand, in a prevention of further uncontrolled collisions of adjacent medication containers. During the evacuation and the subsequent opening of the plastic tube, however, the medication containers may slip sideways, increasing the efforts required for automation for processing further the medication containers. In addition, the medication containers may still collide uncontrollably after opening of the plastic tube, resulting in the aforementioned disadvantages. The medication containers cannot be processed further while being in the transport or packaging container or in the holding structure, but must be isolated first in the conventional manner and handed over to downstream processing stations.

Other comparable transport and packaging containers and supporting structures are disclosed in WO 2011/135085 A1 and WO 2009/015862 A1. However, for the further processing the medication containers always need to be isolated. A further processing of the medication containers in batches while being accommodated in a holding structure as outlined above is not possible.

In the holding structure disclosed in FIGS. 1 to 4 of WO 2009/015862 A1, the resilient holding tabs press firmly against the constricted neck portions at the upper ends of the vials to retain the vials by friction. Thus, the holding structure is of very limited use for vials having high tolerances or having different outer diameters. Furthermore, the vials cannot be retained free of tension in the holding structure, which may result in an undesired bulging of the holding structure, in particular during the processing. The vials can also not be inserted from above into the receptacles of the holding structure.

In the aforementioned holding structures the outer diameter of the vials is used basically as an auxiliary contour for fixing the vials on the holding structure. Therefore, the use of such holding structures is not flexible enough for vials having larger tolerances and/or different outer diameters.

In any case, a direct contact of the bottoms of the medication containers, in particular of the bottoms of vials, is not possible for the conventional holding structures. However, this complicates the further processing of the medication containers particularly when their content is to be subjected to a freeze-drying process (also known as lyophilization or sublimation drying). Furthermore, a further processing of the medication containers directly in the holding structures is not possible, because they are either retained there rigidly or not accessible to a sufficient degree for further processing, for which reason the medication containers conventionally always need to be taken out of the holding structure for a further processing, which is time-consuming and expensive.

SUMMARY

It is an object of the present invention to further enhance a holding structure for concurrently holding a plurality of containers for cosmetic, medical or pharmaceutical applications, particularly of glass or plastic vials, so that the containers can be retained in a simple and reliable manner and can be sterile packaged, unpackaged and processed cost efficiently. According to a preferred further aspect of the present invention such a holding structure shall be configured in particular for a further processing of the containers while these are held in the holding structure.

According to a further aspect of the present invention, which is independent of the aforementioned aspects, furthermore a holding structure for concurrently holding a plurality of containers for cosmetic, medical or pharmaceutical applications, in particular of glass or plastic vials, is to be enhanced further to the effect that processing stations or stations for treatment, such as a freeze-drying facility, can be loaded with holding structures and unloaded more easily and reliably.

According to a further aspect of the present invention, furthermore there is to be provided a corresponding transport and packaging container comprising at least one such holding structure.

According to the present invention, which is preferably planar, in particular rectangular in shape, at least two holding tabs are provided as holding means at the carrier, which are provided at the edge of a respective aperture or receptacle and protrude from an upper side of the carrier for holding the respective container in the aperture or receptacle. Here, according to the present invention the holding tabs are configured such that these are resiliently pivoted or folded back as the containers are inserted into the apertures or receptacles and they are matched to the containers such that these are held by the holding tabs with a radial clearance. The radial clearance allows that containers having different radial tolerances and/or outer dimensions can be retained reliably by one and the same holding structure. Conveniently, the radial clearance is designed and adapted to the outer contours and dimensions of the containers in such a manner that all holding tabs never touch the constricted neck portions at the upper ends of the containers, in particular of the vials, at the same time. At the same time the radial clearance also prevents an undesired tensioning or even bulging of the carrier when holding containers having different radial tolerances and/or outer dimensions, which provides considerable advantages, particularly in the concurrent processing of a plurality of containers while these are held by the holding structure, for example in the freeze-drying and processing at very low temperatures.

Even if the carrier should nevertheless warp or bulge during the processing, nevertheless a uniform contact to the bottoms of all containers held by the holding structure can be accomplished, particularly when these are additionally held by the holding tabs at the holding structure with a sufficient axial clearance, because the axial clearance also allows for a compensation of length tolerances.

The holding tabs are formed or supported resiliently to a sufficient degree so that the containers can be inserted axially, i.e. in the direction of the longitudinal axis of the containers and perpendicular to the plane of the carrier, into the apertures or receptacles from the upper side or from the lower side of the carrier, in particular with resilient deformation of the holding tabs, for example by bending them back. Thus, the loading of the carrier with containers can be automated easily, which is further favored by a regular arrangement of the apertures or receptacles, preferably in a two-dimensional matrix.

The underside of an expanded upper rim portion of the containers has proven to be a preferred location at which the containers are held or supported on the holding tabs, which is typically provided at vials particularly as the so-called rolled edge or as a shoulder. In this region a supporting or bearing surface for holding or supporting the containers is available with a sufficient extension in the radial direction of the apertures or receptacles in order to easily implement the above-mentioned radial clearance for the holding of the containers.

Because the containers can be lifted or moved, for example, rotated, in the apertures or receptacles with very little expenditure of force, they can be processed further easily while they are disposed in the holding structure and held or at least guided by it. This type of support has turned out to be of advantage e.g. for closing the containers by means of crimping a metal lid. The process steps required for this purpose can be performed on the metal lid while the container is held in or at least guided by the aperture or receptacle of the holding structure. This type of support has turned out to be of advantage also in the processing of containers while they are held or accommodated in the holding structure. For example, the holding structures together with the containers accommodated or held by them may be inserted into a freeze-dryer. Because of the holding of the containers in the holding structures with a certain clearance it can be ensured that the bottoms of all the containers evenly rest on a cooling base, such as a cooling finger of the freeze-dryer. Or the containers may be lifted without too much effort in the apertures or receptacles of the holding structure and handled for the processing.

According to a preferred embodiment, the holding tabs are formed as resilient holding tabs, but have a sufficient resiliency to be pivoted back or folded back resiliently to a sufficient extent as the containers are inserted into the apertures or receptacles to make clear the way for the containers into the apertures or receptacles. This can be accomplished easily by a proper dimensioning, selection of the materials and design of the material thickness of the holding tabs. The holding tabs are thus preferably formed from a plastic material.

According to an embodiment, the holding tabs are preloaded resiliently towards a holding position, preferably by means of a resilient return member, for example a return spring or a plastic plate or a resilient plastic structure, which cooperates suitably with the associated holding tab and is disposed or formed on the upper side of the carrier.

According to an embodiment, the holding tabs are matched to the containers such that the containers rest loosely on upper sides of the holding tabs with an expanded rim, which is formed at an upper end of the containers, particularly with the above-mentioned rolled edge. Thus, the containers can be removed from the apertures or receptacles upward without resistance.

According to an embodiment, the holding tabs embrace the expanded rim in such a manner that the containers are held by the holding tabs with a radial clearance or with radial and axial clearance. In this way, the containers may be securely retained in axial direction in the apertures or receptacles. For removing the containers from the apertures or receptacles the tabs only need to be pivoted back or folded back again in the same way as inserting the containers.

According to an embodiment, the holding tabs are disposed and distributed on the upper side of the carrier such that these do not contact each other directly as they are pivoted or folded back and that they do not obstruct a directly adjacent aperture or receptacle. Thus, the packing density of the containers at the carrier can be increased further. In particular, the holding tabs are configured such that directly adjacent holding tabs do not contact each other when they are pivoted or folded back towards the carrier upon insertion of the containers into the associated apertures or receptacles.

According to an embodiment, slanted insertion surfaces are formed at upper ends of the holding tabs each of which passing into a holding nose protruding radially inward for holding the containers. The containers can thus be inserted into the apertures or receptacles more easily and with less expenditure of force. Upon insertion of the containers from above into the apertures or receptacles initially the bottoms or bottom ends of the containers get in contact with the slanted insertion surfaces. Upon further insertion of the containers, the bottom ends or bottoms of the containers slide downward along the slanted insertion surfaces and spread the holding tabs apart or fold or pivot them back. Upon further insertion of the containers finally the cylindrical side walls get in contact with the holding noses and slide therealong, until eventually the underside of the aforementioned rolled edge rests loosely on the holding noses of the holding tabs.

According to an embodiment, the holding tabs or their slanted insertion surfaces associated with a respective aperture or receptacle are twisted in the same direction and by an angle of less than 90°, so that the holding tabs are pivoted or folded back radially and with a movement component in the circumferential direction upon insertion of the containers from the upper side of the carrier into the apertures or receptacles, if viewed in a plan view. Depending on the configuration and distribution of the holding tabs, this may allow that directly adjacent holding tabs do not touch each other, when they are pivoted or folded towards the carrier upon insertion of the containers into the associated apertures or receptacles.

According to a further embodiment, the apertures or receptacles on a lower side of the carrier opposite to the upper side are limited at least in sections by a respective side wall in order to prevent a contact of containers in directly adjacent apertures or receptacles, wherein the side walls are preferably formed such that the containers are freely accessible from the lower side of the carrier. The side walls of adjacent apertures or receptacles are preferably connected to each other, which contributes to a further advantageous stiffening of the carrier. The side walls are preferably formed integrally with the carrier, which can be implemented easily for example by means of plastic injection molding technology.

The bottoms or bottom ends of the containers accommodated in the apertures or receptacles preferably protrude from the lower ends of the side walls, so that the bottoms of the containers are freely accessible from the lower side of the carrier. This allows a processing of the containers, while they are held on the carrier in the apertures or receptacles, as discussed below.

The integral forming of the holding tabs with the carrier allows a cost effective production, for example by injection molding from a plastic material. The resilient holding tabs protrude arcuately from the upper side of the carrier and preferably protrude a little into the associated aperture or receptacle, if viewed in a plan view. Thus, the containers may be held in particular in the region of a constricted neck portion and near the upper open end of a container or vial, as explained in more detail below. The arcuate configuration of the holding tabs facilitates inserting the containers into the apertures or receptacles of the carrier or their removal again.

According to a further embodiment, the holding tabs associated with an aperture or receptacle are disposed and formed symmetrically about a respective center line of the aperture or receptacle. The containers are thus automatically held centered in the respective apertures or receptacles of the carrier. The symmetry also prevents an accidental tilting or twisting of the containers when inserted into or held in the apertures or receptacles of the carrier.

According to a further embodiment, the resilient holding tabs each form a three-point bearing for holding the container in the respective aperture or receptacle of the carrier, whereby an automatic centering of the containers in the associated apertures or receptacles and a very precise and stable definition of the positions of the containers on the carrier is favored even more.

According to a further embodiment, the side walls are disposed distributed in a regular hexagonal arrangement on the lower side and/or upper side of the carrier. Overall, a honeycomb structure is formed in this way, which can contribute advantageously to a further stiffening of the carrier. Here, the side walls of adjacent apertures or receptacles are preferably connected with each other.

According to a further embodiment, the side walls of a respective aperture or receptacle are each formed circumferential and form a hexagonal honeycomb structure on the lower side of the carrier. The side walls of directly adjacent apertures or receptacles merge in the corner regions of the apertures or receptacles and are connected with each other or formed integrally, resulting in a further stiffening of the carrier.

According to a preferred further embodiment, respective three holding tabs protrude from a connecting region of the side walls in a configuration with a threefold-symmetry into the respectively associated apertures or receptacles, so that advantageously a cancellation of forces can be accomplished in the connecting region. Thus, the carrier can hold the plurality of containers with low stress.

According to a further embodiment, the side walls of a respective aperture or receptacle are each formed circular and circumferential. Preferably, the side walls of directly adjacent apertures or receptacles are connected with each other or formed integrally, which also results in a further stiffening of the carrier.

According to a further embodiment, the apertures or receptacles are arranged in a regular arrangement of rows and columns distributed on the carrier, wherein the rows and columns are each offset to one another and form a periodic array. This array is advantageous for an automated treatment of the containers.

According to a further embodiment, the base area of the holding structure can be reduced by removing or folding back the members that can be removed or pivoted back, which are formed along the edges. This allows a higher packing density during the processing of the containers that are accommodated in the holding structures, for example in a sterile tunnel or in a freeze-dryer.

According to a further embodiment, a high packing density and at the same time a mutual stabilization of the positions of the carriers can be implemented as a result of the positive engagement of recesses and/or protrusions, which are formed either on the aforementioned members of the carrier that can be removed or pivoted back or directly in the edge of the carrier, with protrusions and/or recesses of a corresponding shape of a directly adjacent carrier.

According to a further aspect of the present invention, which is independent of the aforesaid aspects, there is further provided a holding structure for concurrently holding a plurality of containers for substances for cosmetic, medical or pharmaceutical applications, in particular of vials, comprising a carrier having a plurality of apertures or receptacles into which the containers can be inserted as well as holding means for holding the containers in the apertures or receptacles, wherein the holding structure has a longitudinal direction (x) and a transverse direction (y). According to the invention directly adjacent holding structures each can be coupled directly with each other so that these are immovable relative to each other in the longitudinal direction and/or in the transverse direction. In other words: the directly adjacent holding structures can be handled together, as a kind of unit consisting of several (of at least two) holding structures, without the need for significantly changing their position relative to each other.

According to the invention a releasable, temporary coupling of the directly adjacent holding structures is chosen for this purpose, wherein in principle any form-fitting or frictional coupling technique can be used, as long as the coupling force that can be achieved by the coupling is larger than the forces typically encountered during handling or processing of the holding structures, which seek again to separate the directly adjacent holding structures from each other. The coupling technique that is chosen may very well allow a certain clearance between the directly adjacent holding structures to avoid excessive stress on the material. Particularly, the coupling structures that are chosen, which are form-locking or frictional coupling structures, may allow a certain resiliency between the directly adjacent holding structures, which can be accomplished easily by a suitable design of the coupling structures.

By means of the releasable temporary coupling according to the invention a plurality of holding structures can be arranged in a row one behind one another or next to each other, coupled with each other and be loaded together in a processing station, such as a freeze-dryer, and removed again. The loading of processing stations, such as freeze-dryers, but can be performed manually but also semi-automatic or fully-automatic by means of suitable adjustment devices. According to the invention the loading of a freeze-dryer can be performed in particular from the outside and inside.

According to a further embodiment, the releasable temporary coupling of the directly adjacent holding structures is effected by means of a positive locking by positive locking structures, which are suitably arranged along the edges of the holding structures and configured to cooperate with each other suitably, in order to achieve a releasable coupling. Here, the positive locking is preferably implemented directly between the form-fitting structures, i.e. without the mediation of a third coupling member, such as a screw, so that the coupling can be implemented in a time-saving and cost efficient manner. To this end, positive-locking structures may be formed on opposite edges of the directly adjacent holding structures that can be transferred to a positive-locking engagement.

The positive-locking structures may be configured in particular for a coupling in the manner of a dovetail joint, a tab and groove coupling or a parallel key coupling. Recesses are also conceivable, for example with a circular cross section, into which correspondingly formed pin-like protrusions of an adjacent holding structure engage positively.

According to a further embodiment the positive-locking structures are formed as protrusions and recesses along the opposite edges of the two directly adjacent holding structures, the base areas of which, each if viewed in a plan view, are different to a rectangular shape and that are formed directly corresponding to each other. The positive-locking structures can thus be latched directly together in a simple manner. Preferably, these protrusions and recesses do not protrude substantially out of the plane defined by the planar holding structure, so that the holding structures are still flat and thus formed in a space-saving manner. The above-mentioned latching is effected by simply lifting and subsequent lowering a holding structure to accomplish the above-mentioned positive-fit coupling between the correspondingly formed positive-locking structures. For example, the protrusions and recesses may have a substantially triangular base area. Preferably, these protrusions and recesses are arranged alternately and in regular intervals to each other along opposite edges of the holding structures, so that in general the holding structures may also be coupled with each other so that they are not aligned in one row next to each other, which may be of advantage, for example, for a more effective use of treatment and processing stations having a non-rectangular base area. The loading of treatment and processing stations can thus be more flexible.

According to a further embodiment side walls, which protrude perpendicularly from surfaces of the holding structures, are formed at least in sections along edges of the protrusions and corresponding recesses. It is advantageous that due to these protruding edges the contact area is increased during pushing and pulling these edges. The edges act quasi as a kind of stop and guiding surface and allow a more precise positive-locking between the directly adjacent holding structures. In particular, the risk of a stacking of the holding structures 'one above the other' can be reduced effectively.

According to a further embodiment, the positive-locking structures comprise a resilient tab with a locking protrusion formed thereon or with a locking recess formed thereon on a first of the two directly adjacent holding structures and a receptacle corresponding to the locking protrusion or a protrusion corresponding to the locking recess on the second of the two directly adjacent holding structures. For the coupling the holding structures are moved towards each other until finally the front end of the resilient tab gets in contact with the edge of the adjacent holding structure. In the further approach eventually the bottom of the resilient tab slides along the surface of the adjacent holding structure, and in this state the resilient tab is bent slightly upward. Finally, the locking protrusion and the corresponding receptacle engage positively into each other and the resilient tab returns back to its relaxed home position, wherein as a result of the positive coupling between the locking protrusion and the corresponding receptacle a reliable coupling between the adjacent holding structures is implemented. The coupling and release of the coupling is advantageously simple.

Another aspect of the present invention further relates to a transport and packaging container comprising at least one holding structure as set forth above and disclosed hereinafter in more detail.

Another aspect of the present invention relates to a transport and packaging container comprising at least one holding structure accommodated therein, as set forth above, for holding the plurality of containers in the transport or packaging container.

BRIEF DESCRIPTION OF THE DRAWINGS

The invention will now be described by way of example and with reference to the accompanying drawings, from which further features, advantages and problems to be solved will become apparent. In the drawings.

DETAILED DESCRIPTION

Figure 1A:
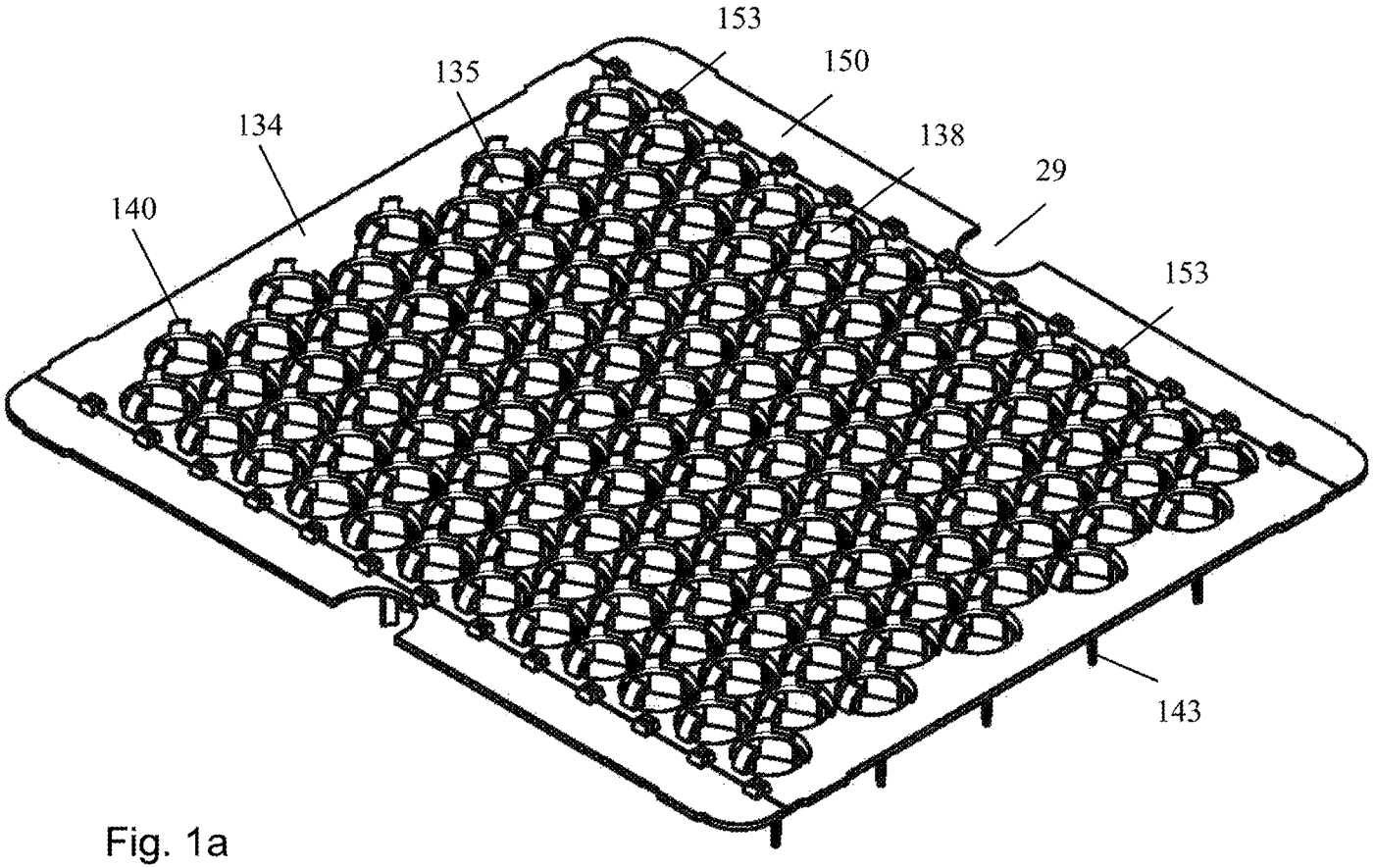
FIGS. 1*a* and 1*b* show a holding structure according to a first embodiment of the present invention in a perspective plan view and in a plan view.

In the drawings, identical reference numerals designate identical or substantially equivalent elements or groups of elements.

According to the present invention, a supporting structure as well as a transport and packaging container accommodating such a holding structure are used, as described below, for concurrently holding a plurality of containers for storage of substances for cosmetic, medical or pharmaceutical applications, preferably in an array configuration, in particular in a matrix configuration with regular intervals between the containers along two different directions in space, preferably along two mutually orthogonal spatial directions or in regular rows, which are offset to each other.

Figure 1B:
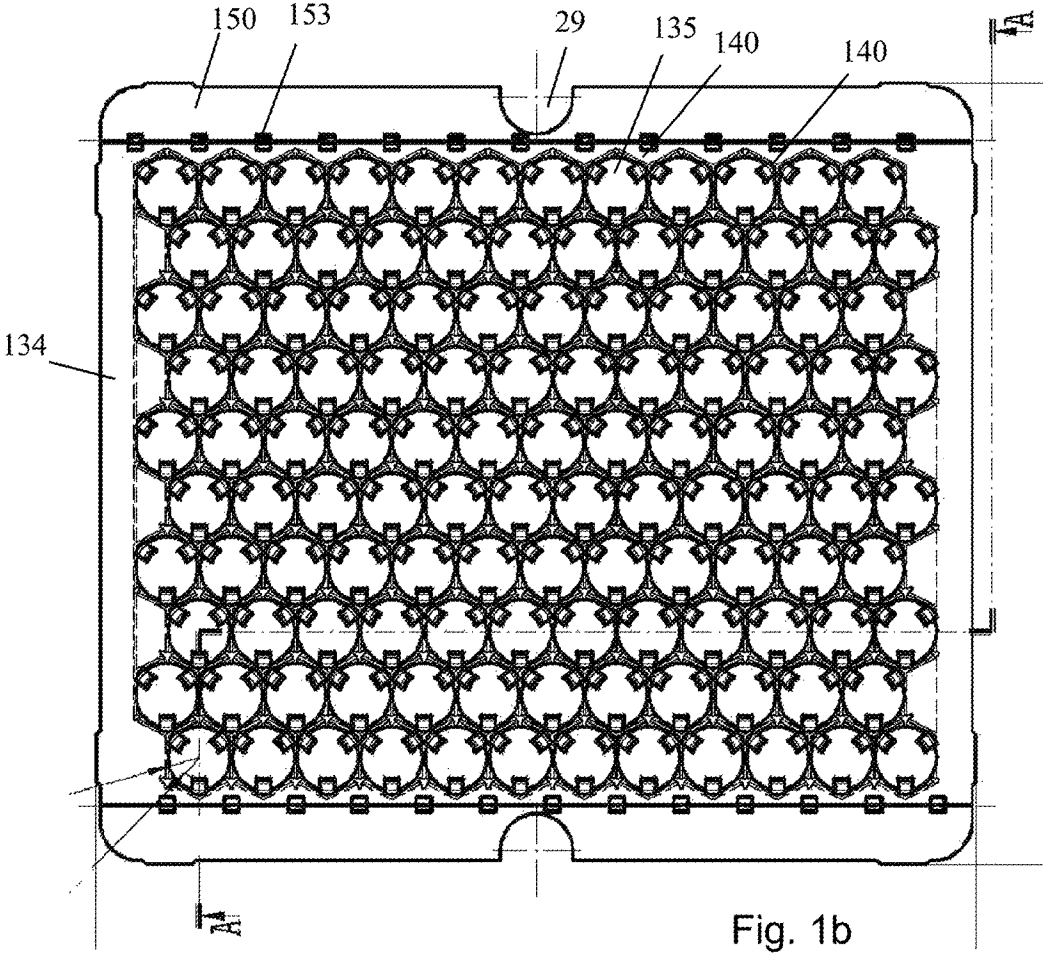
Figure 1C:
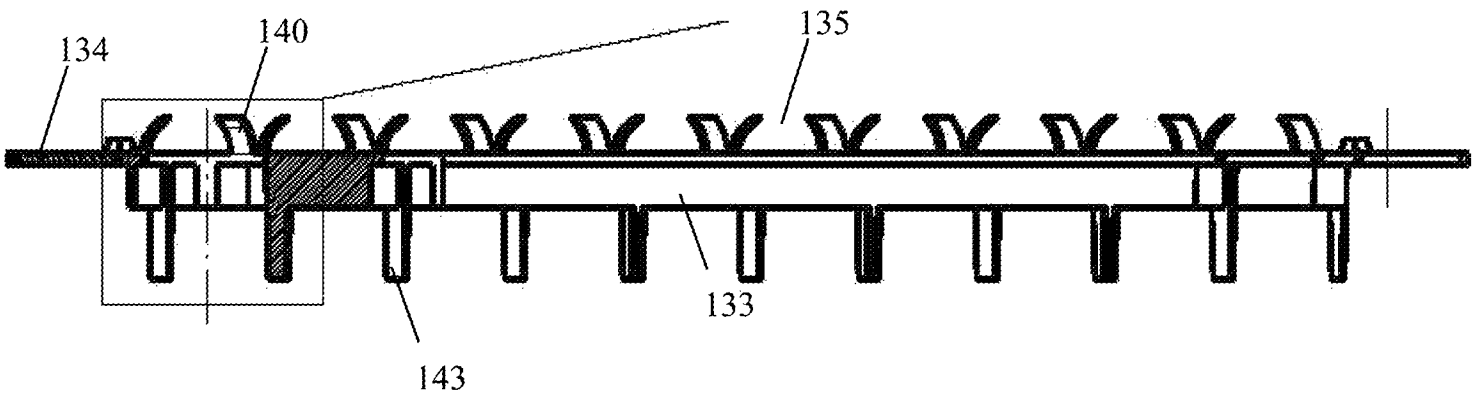
FIG. 1*c* is a partial cross-section along A-A of FIG. 1*b;*
Figure 1D:
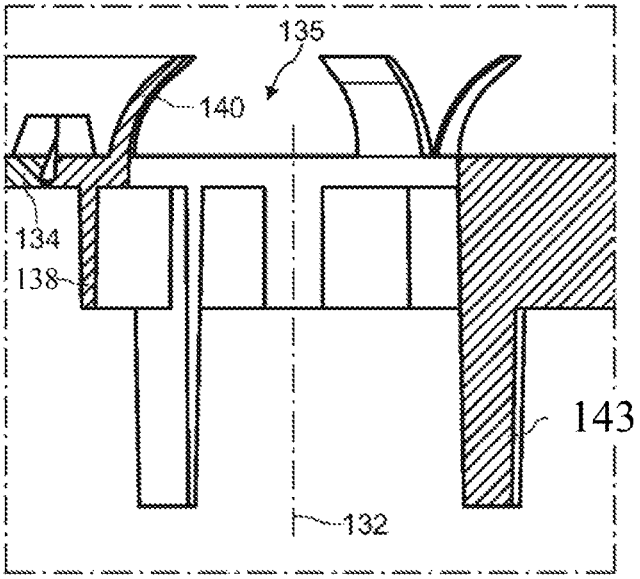
FIG. 1*d* shows a greatly enlarged partial cross-section in the insert shown in FIG. 1*c;*
Figure 1E:
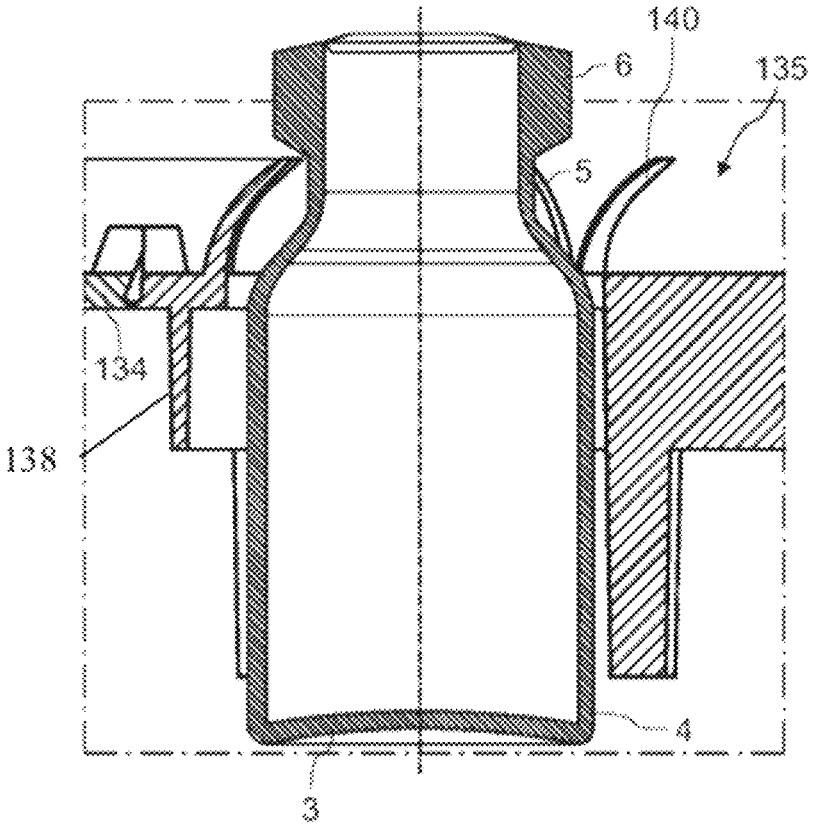
FIG. 1*e* shows the holding of a container in the apertures of a holding structure according to the first embodiment in the greatly enlarged partial cross-section of FIG. 1*d;*

An example of such medication containers embodied as vials is schematically shown in FIG. 1*e* in a longitudinal sectional view. These have a cylindrical basic shape, having a cylindrical side wall with—within tolerances—constant inner and outer diameters, which project vertically from a flat vial bottom 3, which merges in a constricted neck portion 5 of a relatively short axial length near the upper open end of the vial and then merges in an expanded upper rim 6 (so-called rolled edge), which has a larger outer diameter than the associated neck portion 5 and is configured for connection to a closure member. As can be concluded from FIG. 1*e*, the underside of the rolled edge 6 is slanted and extends downward under an acute angle and towards the constricted neck portion 5. As shown in FIG. 1*e*, a gap in radial direction is formed between e.g. the left holding tab 140 (or a plurality of holding tabs or all holding tabs of an aperture or receptacle) and the constricted neck portion 5 of the container.

The neck portion 5 can be formed with smooth walls and without an external thread or may be provided with an external thread for screwing on a closure member. For example, a stopper (not shown) may be inserted into the inner bore of the neck portion 5 and the upper rim 6, whose upper end is connected with the upper rim 6 of the vial in a gas-tight manner and protected against the intrusion of contaminants into the vial, for example by crimping a metal protective foil, which is not shown. Such vials are radially symmetric and are made of a transparent or colored glass or of a suitable plastic material by blow molding or plastic injection molding techniques, and in general can be internally coated so that the material of the vial emits minimal impurities to the agent to be received.

Another example of a medication container according to the present application are ampoules, cartridges, syringes or injection containers. Ampoules or cartridges are containers for medication agents for usually parenteral administration (injection), for cosmetics and other agents and are usually cylindrical in shape with an extended tip (spear or head) and a flat bottom or also with two extended tips at both ends. These may be formed in particular as snap-off ampoules with an annular predetermined breaking point around the ampoule neck or as an OPC cartridge (One-Point-cut ampoule) having a breaking ring inscribed into the glass. Syringes or injection containers, also known as injection flasks, vials or reusable ampoules, are cylindrical containers of glass or plastic shaped similar to a bottle, usually having a relatively small nominal volume (e.g. 1 ml, 10 ml). They are sealed with a rubber plug with septum (puncture rubber). For protecting the septum and fixing the rubber plug an outer closure (beaded cap or cramp), often made from an aluminum sheet, is necessary. In a cartridge the liquid is stored in a cylinder, which is closed at one end by means of a thick rubber or plastic plug. This acts as a piston when the content is pressed out using a cartridge syringe. At the other end the cylinder is closed only by means of a thin diaphragm, which is pierced from the rear end of the cartridge syringe (a cannula sharpened on both sides) in the application. Cylindrical ampoules are often used in dentistry for local anesthesia. Special cylindrical ampoules with a specially shaped front part (e.g. thread) are used for insulin therapy in insulin pens.

In the sense of the present invention, such containers are used for storage of substances or agents for cosmetic, medical or pharmaceutical applications, which are to be stored in one or several components in solid or liquid form in the container. Especially in the case of glass containers storage periods can amount many years, notably depending on the hydrolytic resistance of the glass type used. While, in the following, cylindrical containers are disclosed, it should be noted that the containers, in the sense of the present invention, may also have a different profile, for example a square, rectangular or polygonal profile.

Inevitably such containers have tolerances due to the production which can be of the order of one or several tenths of a millimeter in particular for glass containers. To compensate for such manufacturing tolerances, while ensuring that all bottoms 3 of the vials can be disposed in a plane, according to the present invention the containers are fixed on a holding structure. Here, this holding of the containers is implemented in the transition region between the constricted neck portion 5 and the expanded upper rim 6. In particular, the underside of the rim 6 of the container is supported on the upper ends of holding tabs 140 in the transition region towards the constricted neck portion 5, as described below in more detail. The holding tabs 140 are preferably formed from a sufficiently flexible or resilient plastic. As an alternative, however, the holding tabs may also be designed to be relatively stiff but supported movably on the upper side of the carrier 134 so that they are pivoted or flapped back resiliently out of the aperture 135 as the containers are inserted, as described below. For this purpose, the holding tabs may be preloaded resiliently towards the holding position shown in FIG. 1*e* by means of resilient return members (not shown), such as return springs or resilient plastic structures or resilient plastic plates.

For concurrently holding a plurality of containers, according to a first embodiment of the present invention, as shown in FIGS. 1*a* and 1*b*, a planar rectangular carrier 134 is provided that is formed of a plastic material, for example by punching or injection molding, and comprises a plurality of apertures 135 for accommodating the glass vials 2. The apertures 135 are arranged in a regular two-dimensional array, in the illustrated embodiment in a matrix array of rows and columns extending perpendicularly, which are arranged at equidistant intervals and regularly offset to each other in a periodic arrangement.

The apertures 135 are delimited by side walls 138 (see FIG. 1*d*) on the lower side of the carrier 134. According to FIG. 1*b*, resilient holding tabs 140 protrude arcuately from the upper side of the carrier 134, if viewed in a plan view, into the associated apertures 135. The resilient holding tabs 140 and the side walls 138 are preferably formed integrally with the planar carrier 134, e.g. by means of a one-component or two-component plastic injection molding process.

As can be concluded from the synopsis of FIGS. 1*b* and 1*d*, the side walls 138 are arranged on the lower side of the carrier 134 in a regular hexagonal configuration. The side walls 138 are circumferential, but may be formed as relatively short side wall portions for delimiting an associated aperture or receptacle only in sections. In each case, a collision of containers, which are accommodated in the directly adjacent apertures 135, is prevented by the side walls 138. According to FIG. 1*c* pins 143 protrude from the lower side of the carrier 134, by means of which the carrier 134 can be placed on a supporting surface spaced apart from the latter.

According to FIG. 1*b*, the side walls 138 each merge in the corner regions of the apertures 135 and are there connected with each other or formed integrally. The resilient holding tabs 140 protrude into the adjacent apertures 135 in these corner regions in a configuration with a three-fold point symmetry. This results in a symmetrical force distribution when holding the containers by means of the holding tabs 140. The holding tabs 140 thus result in an advantageous three-point bearing of the containers in the apertures, so that the containers are automatically supported in a respective aperture 135 centered with respect to a center line 132 (see FIG. 1*d*).

As can be concluded from FIG. 1*b*, the holding tabs 140 protrude from the side walls 138 of the carrier 134 in corner regions of the apertures 135, i.e. where the side walls 138, which are connected with each other or formed integrally, form portions with a relatively high stability. Conveniently, also the aforesaid pins 143 may be formed integrally in these regions.

In an alternative embodiment in which the side walls of a respective aperture or receptacle are each circular in shape and circumferential, the side walls are also preferably connected to each other or formed integrally. Here, the holding tabs protrude from the same regions as in the arrangement shown in FIG. 1*b*. In these regions, the gaps between the circular side walls may also be filled.

FIG. 1*c* shows a partial sectional view of the holding structure along A-A of FIG. 1*b*. It can be seen that the carrier 134 is delimited on the lower side by a circumferential rim 133 on which the carrier 134 can be supported on a circumferential step 13 (see FIG. 2*a*) of a transport or packaging container 1.

FIG. 1*d* shows a greatly enlarged partial sectional view of the insert shown in FIG. 1*c*. It can be seen that the containers can be inserted easily from below into the apertures 135 of the carrier 134. Upon insertion of the containers into the apertures 135 there is an elastic bending of the resilient holding tabs 140.

Depending on the specific configuration of the containers to be supported these can in principle also be inserted from above into the apertures 135 of the carrier 134 so that they are held on the carrier 134. This has the advantage that the risk can be reduced further that a liquid or other content of the containers from the inner volumes of the containers can arrive uncontrollably on the holding structure, in particular on the carrier plate 134, during their insertion into the apertures and during the pivoting back of the holding tabs 140. For this purpose slanted insertion surfaces may be provided on the upper sides of the resilient holding tabs 140, such as those described in more detail below with reference to FIG. 2 for an alternative embodiment.

By means of the strength, material and design of the resilient holding tabs 140 the force required for inserting and removing a container can be specified easily.

According to the present invention, the containers are supported loosely on the holding tabs at least with a radial clearance and preferably both with radial and axial clearance. In this way, even large tolerances of containers and different outer diameters can be easily compensated for in the region of the neck portion 5. Namely, for supporting the containers it is sufficient if the rolled edge 6 still rests on the upper sides of the holding tabs 140. Basically thereby also containers of various types, e.g. with different diameters in the region of the neck portion 5, can be held by one and the same holding structure.

FIG. 1*e* illustrates this in the same greatly enlarged partial sectional view as shown in FIG. 1*d* and illustrates the holding of a container in an aperture 135 of the carrier 134. According to FIG. 1*e* the bottom of the expanded rim 6 rests loosely on the front ends of the resilient holding tabs 140 in the transition region between the constricted neck portion 5 and the rim 6 for fixing the position of the container. As can be seen in FIG. 1*e*, a gap exists between the holding tabs 140 (see left-hand side of the drawing) and the constricted neck portion 5, which enables a radial clearance. Due to this support with radial clearance, depending on the specific design of the container, the possibility exists to displace the container supported by the holding tabs 140 in axial direction, i.e. in the longitudinal direction of the container, for example until the bottoms 3 of all containers supported by the carrier 134 are held at the same distance to the carrier 134 to jointly span a plane.

According to FIG. 1*e* the container is inserted into the aperture 135 until the expanded rim 6 is supported on the front ends of the holding tabs exactly at the transition region between the constricted neck portion 5 and the expanded upper rim 6. This can be accomplished, for example, by inserting the containers from below into the apertures 135 of the carrier 134 and by subsequent pushing down of the containers, namely until the front ends of the holding tabs abut exactly at the transition region between the constricted neck portion 5 and the expanded upper rim 6. In the holding position shown in FIG. 1*e*, a certain radial distance between the step-like transition region between the upper rim 6 and the constricted neck portion 5 and the front ends of the holding tabs 140 is provided in any case for the great majority of the fixed containers. In this way, manufacturing tolerances of the containers in the axial direction and also manufacturing tolerances in the radial direction can be compensated for, and thus also containers with different diameters can be supported in the region of the constricted neck portion 5 by one and the same carrier 134. In this way also potential tension in the plastic of the carrier 134 caused by the accommodation of containers with a too large outer diameter can be kept small.

According to an alternative embodiment, as described below with reference to FIG. 2*g*, the containers may also be supported on the carrier 134 in a positive-fit manner.

Figure 2A:
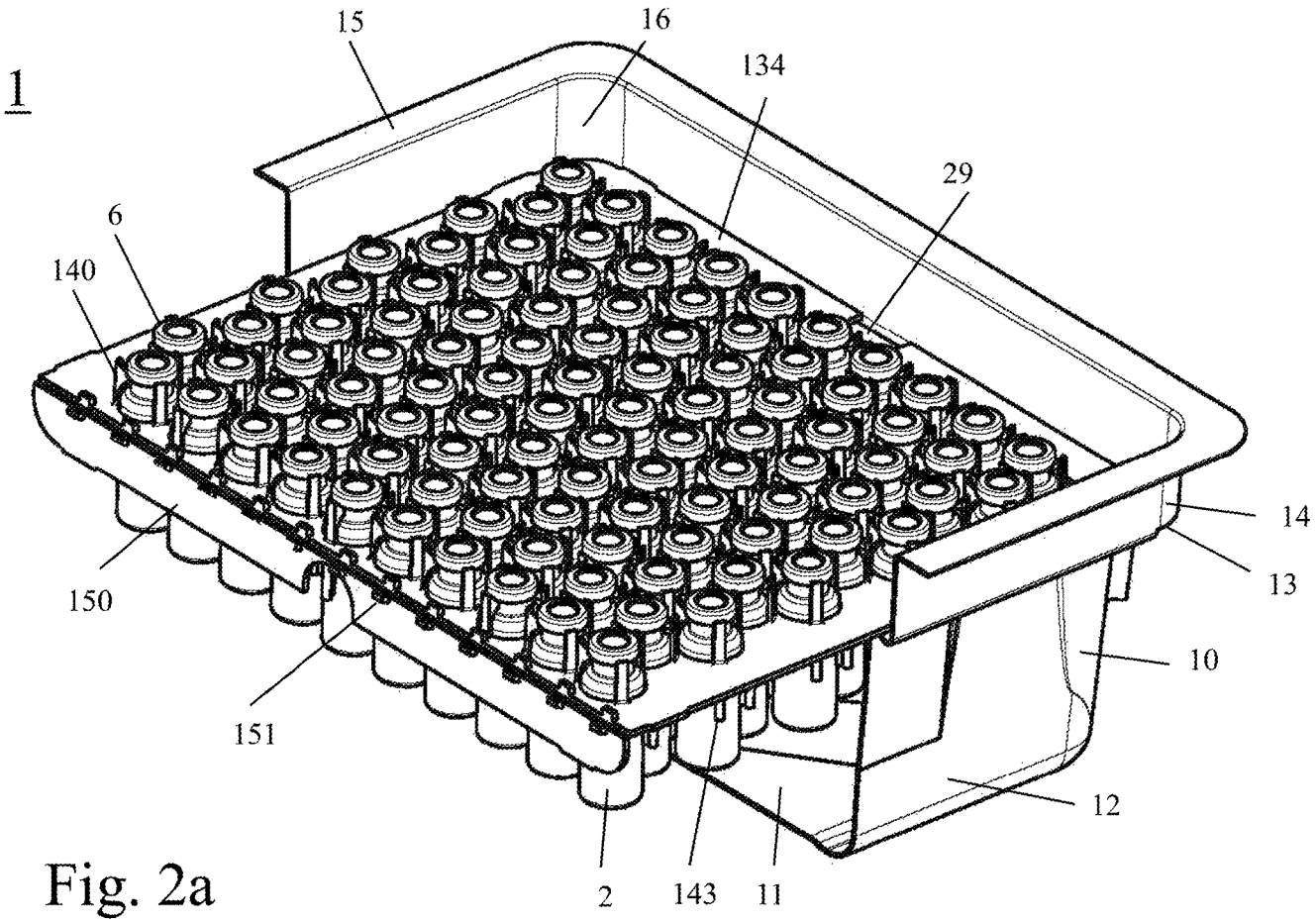
FIG. 2*a* shows a transport or packaging container with a holding structure according to a second embodiment of the present invention accommodated therein and with containers accommodated by it.

For the transport and packaging of the holding structure described above together with the containers accommodated therein, a transport and packaging container 10 is used, such as this is schematically shown in FIG. 2*a* for a holding structure or carrier 134 according to a second embodiment of the present invention. According to FIG. 2*a* the transport and packaging container 10 is substantially box-shaped or trough-shaped and comprises a bottom 11, a circumferential side wall 12 extending perpendicularly, a step 13 projecting substantially perpendicularly, a circumferential upper side wall 14 and an upper edge 15 on which a flange is formed. Conveniently, the corners 16 of the transport and packaging container 10 are rounded. The upper side wall 14 may be formed inclined at a slight angle of inclination relative to a line perpendicular to the bottom 11 in order to facilitate the insertion of the holding structure 134. Such a transport and packaging container 10 is preferably formed of a plastic material, in particular using plastic injection molding technology, and is preferably formed of a clear transparent plastic material to enable an optical inspection of the holding structure 134 accommodated in the transport and packaging container 10 and of the containers 2 supported by it.

For accommodating the holding structure 134 in the transport and packaging container 10, it may be surrounded by a circumferential peripheral web 133, as shown in FIG. 1*c*. Such a peripheral web may also be formed in sections continuously along the peripheral edge. For a reliable positioning of the holding structure 134 in the transport and packaging container 10, the holding structure 134 and the transport and packaging container 10 comprise positioning structures that are cooperating with each other, in particular in a form-fitting manner. Thus, positioning structures in the form of protrusions or recesses (or cavities) may be formed at an appropriate location, particularly on the step 13 or on supporting surfaces 18 (see FIG. 2*b*) of the transport and packaging container 10, which cooperate in a form-fitting manner with correspondingly configured recesses (or cavities) or protrusions of the holding structure for precisely positioning the holding structure 134 in the transport and packaging container 10. For this purpose, a plurality of pin-like protrusions may be formed particularly on the step 13 of the transport and packaging container 10, which cooperate with corresponding centering apertures formed in a supporting frame of the holding structure 134. According to FIG. 2*a*, the step 13 of the transport and packaging container 10 is formed as a circumferential, planar supporting surface on which the holding structure 134 is directly supported. According to further embodiments, also supporting surfaces 18 or supporting members may be formed on the side walls 12 of the transport and packaging container 10, in particular in the form of protrusions. In this way, the holding structure 134 can be positioned precisely in the transport and packaging container 10 and in this way the plurality of vials 2 can be disposed and supported in a regular array and at precisely defined positions in a transport and packaging container 10 with standardized dimensions. Particularly, in this way it can be accomplished that all bottoms or bottom ends of the vials 2 are disposed in a plane jointly spanned and in parallel with the bottom 11 or upper edge 15 of the transport and packaging container 10.

Although, in FIG. 2*a*, the bottom 11 of the transport and packaging container 10 is shown to be closed and formed integral with the side wall 12, the lower end of the transport and packaging container 10 may also be open in the manner of the upper end, in particular provided with a flange-like lower edge in the manner of the upper edge 15 so that the bottoms of the vials 2 are freely accessibly from the lower side of the transport and packaging container 10, e.g. for processing steps in a sterile tunnel or in a freeze-dryer, as explained hereinafter in more detail.

As shown in FIG. 2*a*, in the regular arrangement according to FIG. 2*a* the plurality of vials 2 is arranged in a plane and distributed along two mutually orthogonal directions at predetermined constant intervals with each other. In principle, also other regular arrangements are conceivable, for example adjacent rows or columns of containers 2 may be mutually offset to each other by a predetermined length, namely in a periodic arrangement having a predetermined periodicity. Thus, automated manufacturing facilities can expect the containers 2 at precisely predetermined positions when these are transferred to a processing station, which significantly reduces the automation effort. As explained below in more detail, according to the present invention the containers may also be processed all together inside the holding structure 134 or inside the transport and packaging container 10, in particular in a sterile tunnel or freeze-dryer.

For facilitating the insertion of the holding structure 134 into the transport and packaging container 10 and its removal therefrom, access apertures 29 are formed on two longitudinal sides of the holding structure 134, which are used by gripping arms or the like to grip the holding structure 134. As viewed in longitudinal or transverse direction of the holding structure 134, the access apertures 29 may be offset to one another, which further simplifies an unambiguous positioning of the holding structure 134 in the transport and packaging container 10.

Figure 2B:
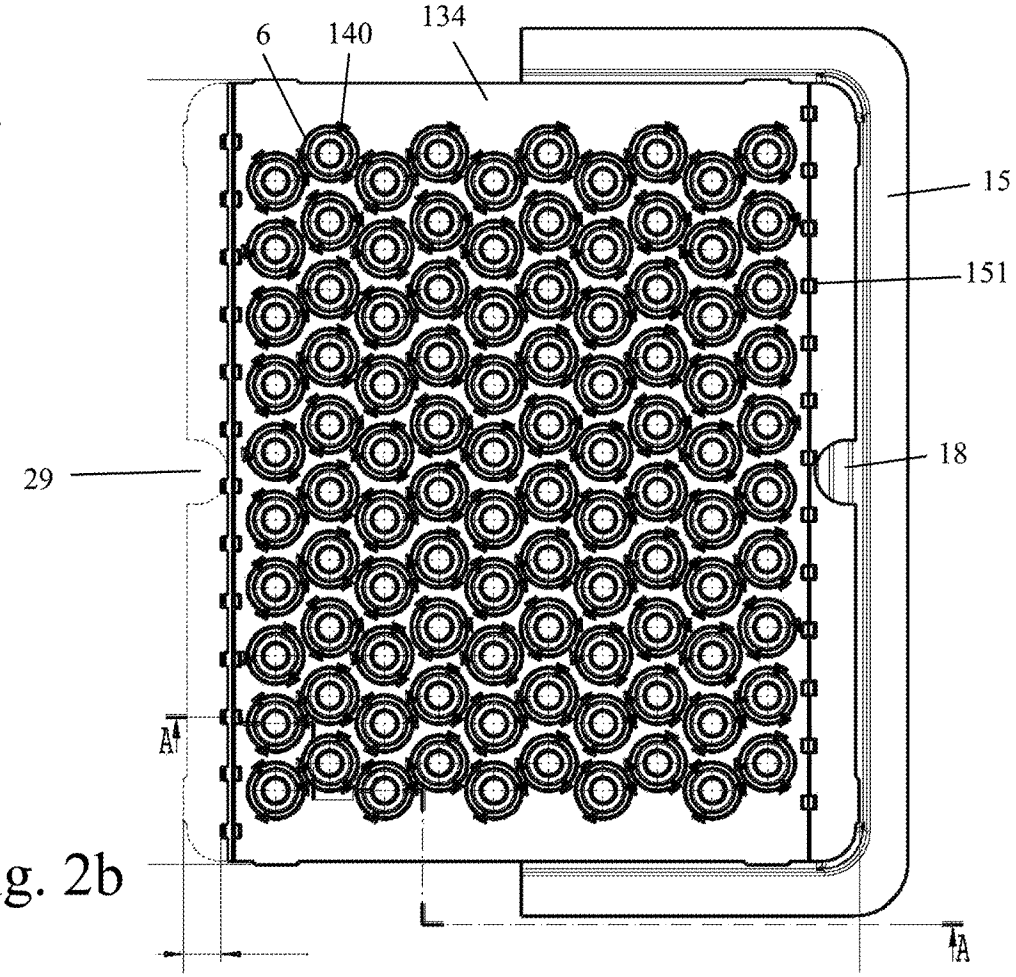
FIG. 2*b* shows the transport or packaging container of FIG. 2*a* in a partial cross-section and in a plan view.
Figure 2C:
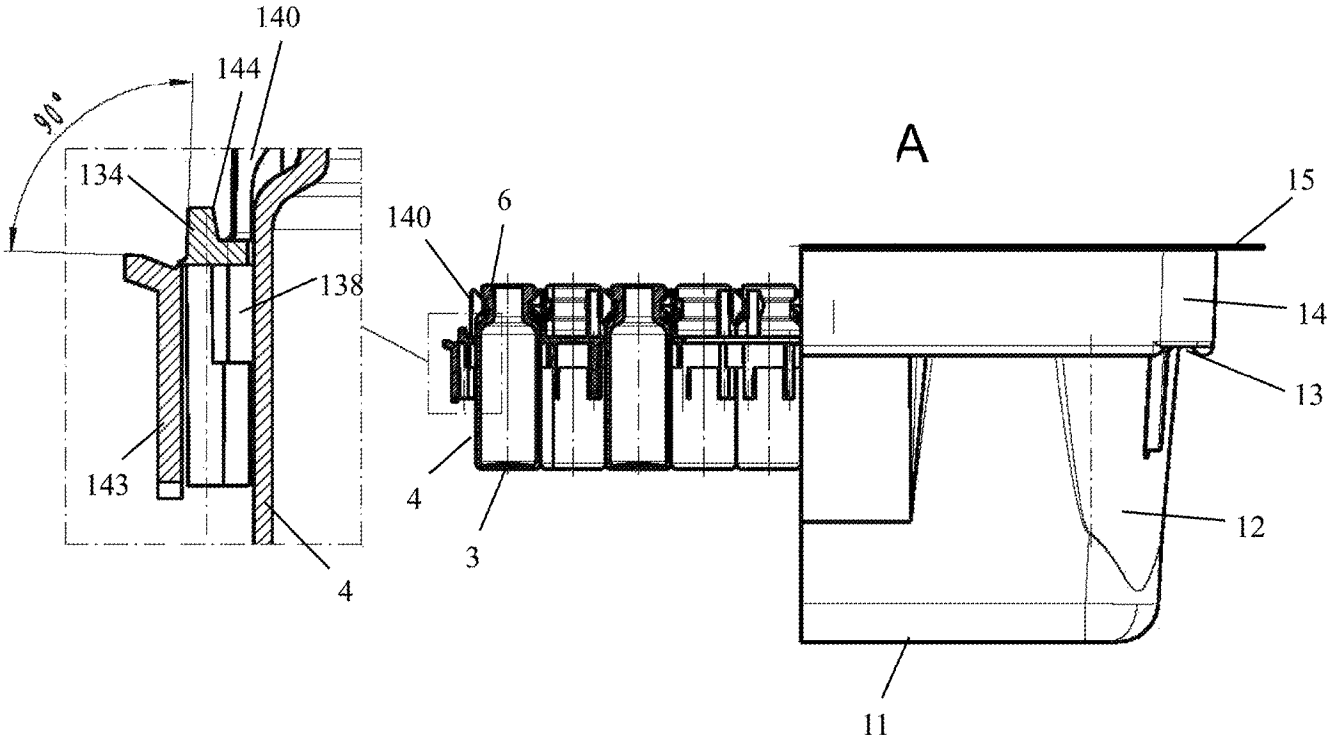
FIG. 2*c* shows the holding of containers in the holding structure according to the second embodiment and details of it in two enlarged partial cross-sectional views.

FIG. 2*c* shows the holding of containers in the holding structure according to the second embodiment and details thereof in two enlarged partial sectional views along A-A of FIG. 2*b*. Particularly, it can be seen that slanted stop noses 144 are provided on the upper side of the carrier, which limit the pivoting back of the resilient holding tabs 140 upon insertion of the containers.

Figure 2D:
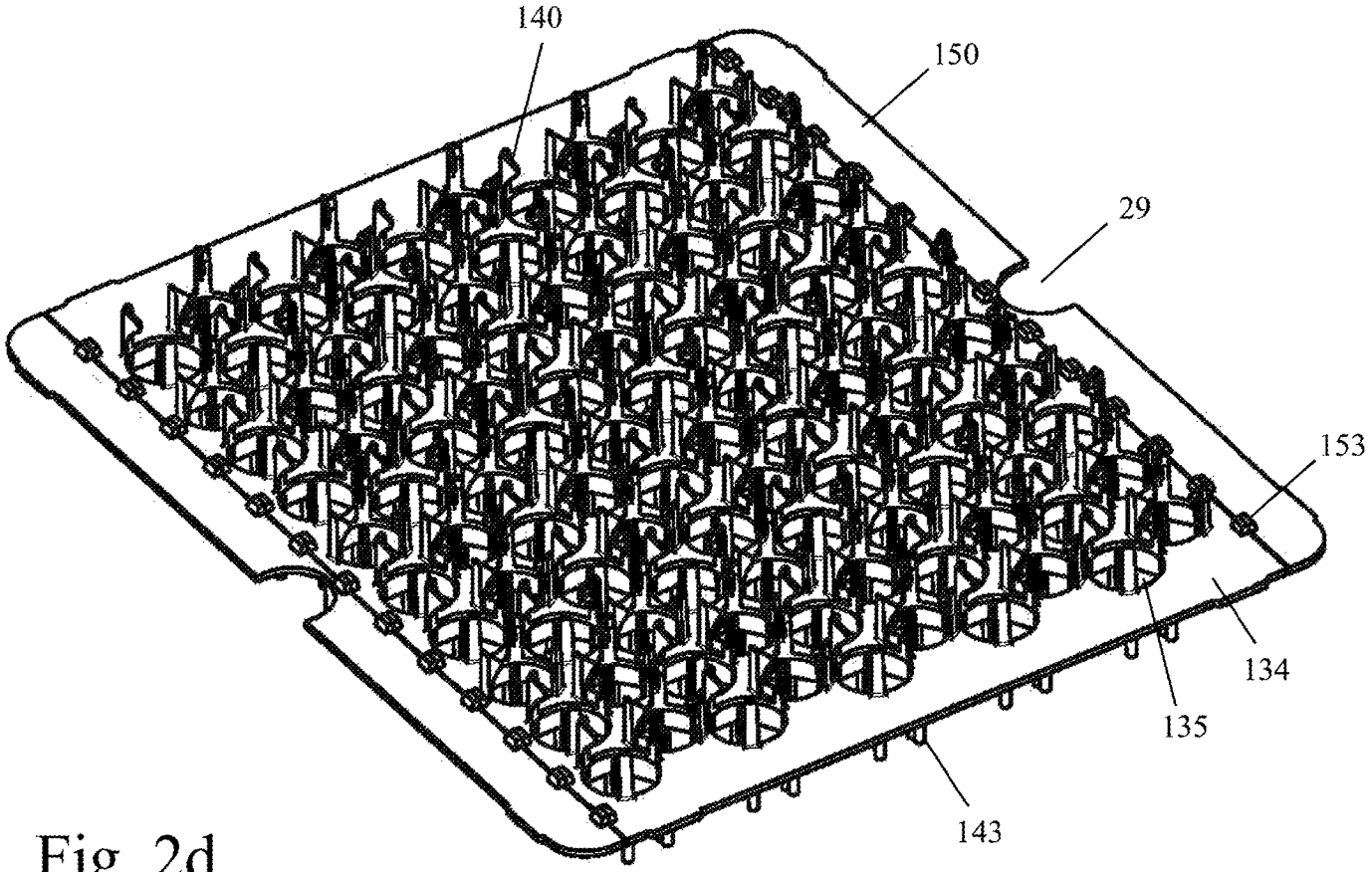
FIG. 2*d* shows the holding structure of FIG. 2*a* without containers in a perspective plan view.

FIG. 2*d* shows the holding structure of FIG. 2*a* without containers in a perspective plan view. As can be seen, the resilient holding tabs 140 are flag-like and formed with a holding nose protruding inward in radial direction, as shown in more detail in the greatly enlarged partial cross-section through this holding structure shown in FIG. 2*f* According to FIG. 2*f*, the resilient holding tabs 140 are connected with the carrier 134 via a resilient base 140*a* protruding perpendicularly from the upper side of the carrier 134. The base 140*a* passes over into a portion 140*b* curved radially inward, which finally passes over into the holding nose 140*c*, on which the expanded rim 6 (see FIG. 1*e*) of the containers rests, as described above with reference to FIG. 1*e* for the first embodiment. Here, the holding nose 140*c* protrudes into the aperture of the carrier 134. The holding nose 140*c* passes over into a slanted insertion surface 140*d* extending slanted upward, which connects with the upper end of the holding tab 140. Due to the slanted insertion surface 140*d* on the upper side of the holding tab 140 and due to the curved portion 140*b* of the holding tab 140, which is open towards the bottom, the containers can be inserted selectively either from above or from below into the apertures of the carrier 134 and taken out again.

As the containers are inserted from above into the apertures, at first the bottoms or bottom ends of the containers get in contact with the slanted insertion surfaces 140*d* of the holding tabs 140. Upon further insertion of the containers the bottom ends or the bottoms of the containers slide downwards along the slanted insertion surfaces 140*d* and thereby resiliently spread the holding tabs 140 increasingly apart or flap or pivot them back. Upon further insertion of the containers finally the cylindrical side walls of the containers (see FIG. 1*e*) get in contact with the holding noses 140*c* and slide therealong, until eventually the undersides of the expanded rims of the containers rest loosely on the holding noses 140*c* of the holding tabs 140. Afterwards, the containers can be removed from the apertures of the carrier 134 either upward with reversed motion sequence of the holding tabs 140 and without resilient bending of the holding tabs 140 or downward with resilient bending of the holding tabs 140.

As the containers are inserted from below into the apertures, at first the upper ends of the containers get in contact with the curved portions 140*b* of the holding tabs. Upon further insertion of the containers the uppers ends of the containers slide upwards along the curved portions 140*b* and thereby resiliently spread the holding tabs 140 increasingly apart or flap or pivot them back. Upon further insertion of the containers the undersides of the expanded rims of the containers slide beyond the holding noses 140*c* of the holding tabs 140 and finally rest loosely on the holding noses 140*c* of the holding tabs 140. Afterwards, the containers can be removed from the apertures of the carrier 134 either downward with reversed motion sequence of the holding tabs 140 and with resilient bending of the holding tabs 140 or upward without resilient bending of the holding tabs 140.

Figure 2E:
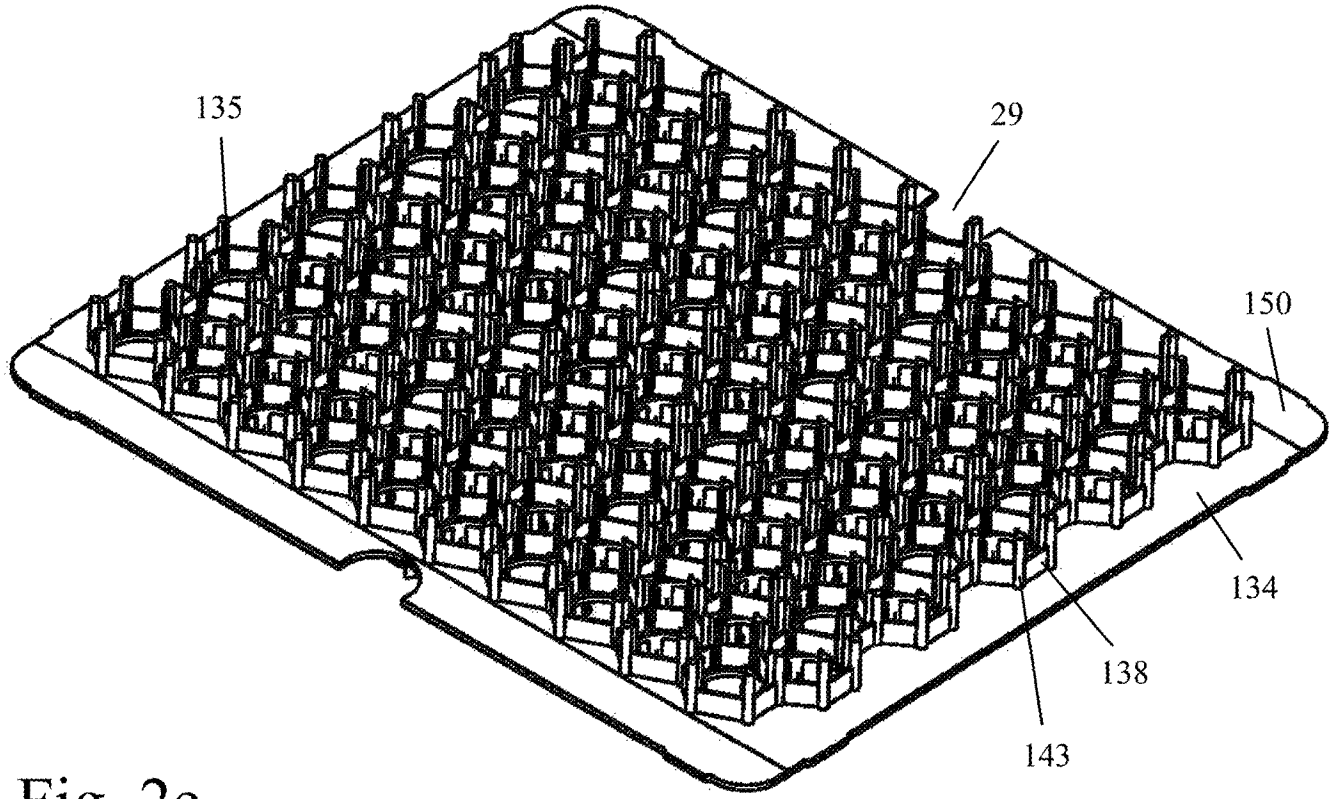
FIG. 2*e* shows the holding structure of FIG. 2*a* without containers in a perspective bottom view.

FIG. 2*e* shows the holding structure of FIG. 2*a* without containers in a perspective bottom view. The honeycomb-like, hexagonal configuration of the circumferential side walls 138 can be seen, and in their corner regions pins 143 protrude perpendicularly from the lower side of the carrier 134. These pins 143 serve as spacers when placing the carrier 134 on a supporting surface, for example on the bottom 11 of a transport and packaging container (see FIG. 2*a*), but at the same time prevent the contact of the containers with each other.

Figure 2F:
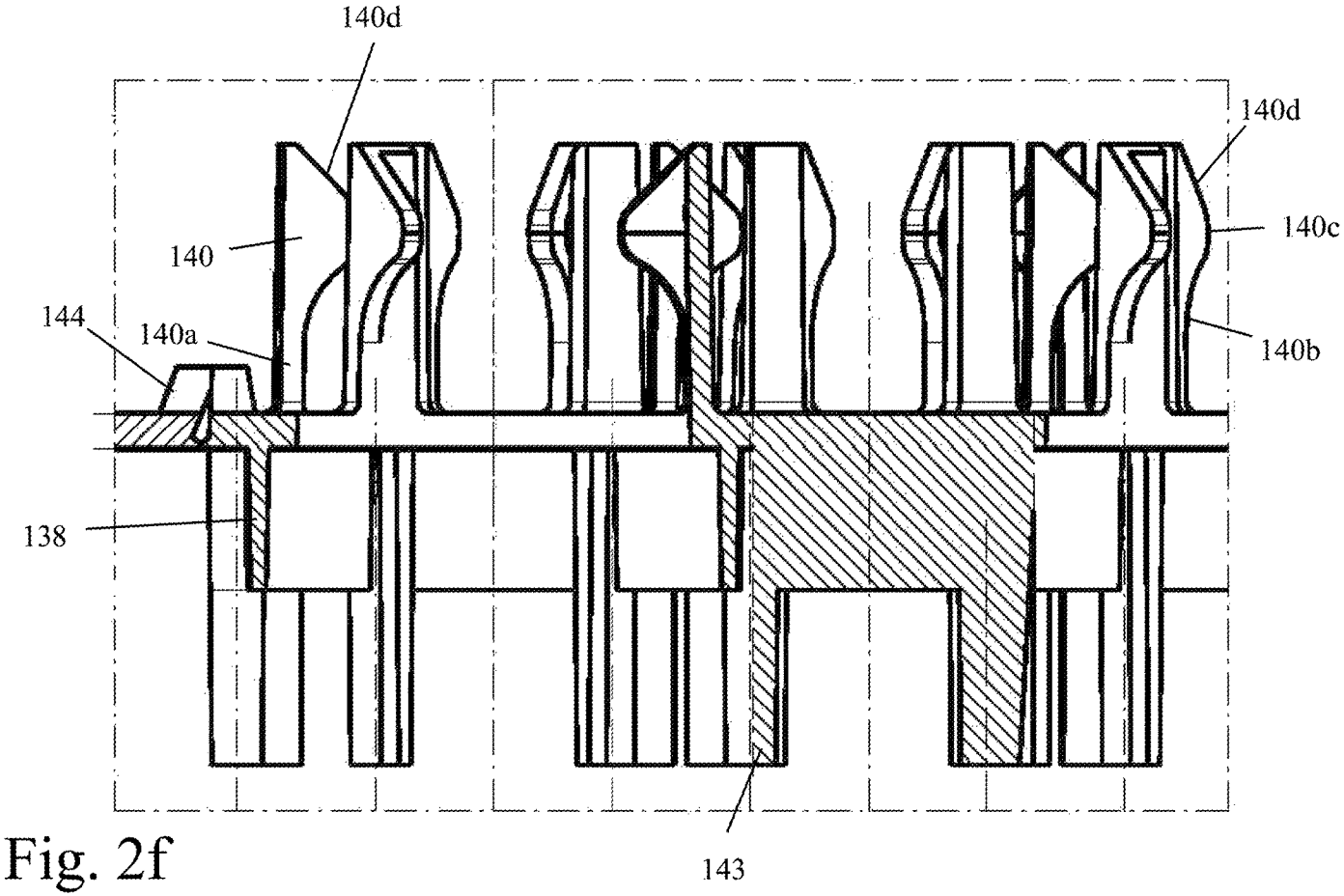
FIG. 2*f* is a further partial cross-section of the holding structure of FIG. 2*a* without containers.
Figure 2G:
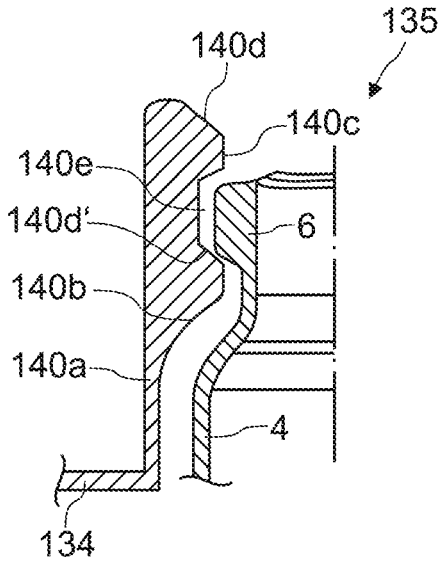
FIG. 2*g* shows the holding of a container in a holding structure according to a further embodiment of the present invention in a greatly enlarged partial cross-section.

FIG. 2*g* shows the holding of a container in a holding structure according to a further embodiment of the present invention in a greatly enlarged partial sectional view. In contrast to the second embodiment, here the containers 6 are embraced in a positive-fit manner at their expanded upper rim portions 6 (rolled edge), wherein a sufficient radial clearance, as described above, is ensured, as indicated in FIG. 2*g* by the gap in the radial direction. As an alternative, in addition to this radial clearance a sufficient axial clearance may be ensured, as indicated in FIG. 2*g* by the gap in the axial direction. To this end, a C-shaped recess 140*e* is provided at the front end of the holding nose 140*c* (see FIG. 2*f*), which passes over into the holding nose 140*c* via slanted surfaces 140*d*'. In the holding position of FIG. 2*g*, the expanded rim portion 6 rests loosely and with radial clearance on the lower slope 140*d*' of the recess 140*e*. As shown in FIG. 2*g*, a sufficient axial clearance may be provided between the upper end of the expanded rim portion 6 and the upper slope 140*d*' of the recess. Overall, the expanded rim portion 6 is embraced by the holding tab 140 like a clamp and positively. The slanted insertion surface 140*d*', the curved portion 140*b* and the slopes 140*d*' of the recess thereby allow insertion of the containers into the receptacles and their removal without too much effort by a resilient bending back of the holding tabs 140.

Figure 2H:
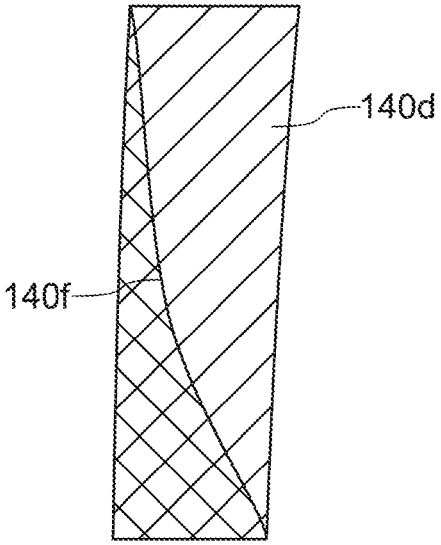
FIG. 2*h* shows a slanted insertion surface of a holding tab according to a variant of the holding structure of FIG. 2*a* in a greatly enlarged plan view.

FIG. 2*h* is a greatly enlarged plan view of a slanted insertion surface of a holding tab according to a variant of the holding structure of FIG. 2*a*. According to FIG. 2*h* the slanted insertion surface 140*d* is overall twisted due to an arcuate ridge 140*f* formed thereon. This spiral slanted insertion surface 140*d* is formed in the same manner on all holding tabs of the apertures or receptacles. Overall, the slanted insertion surfaces are curved by an angle of less than 90°, if viewed in a plan view. In cooperation with the container, this causes that the holding tabs are not only pivoted back or folded back radially outward but at the same time rotated back with a movement component in the circumferential direction in correspondence to the geometry of the slanted insertion surfaces 140*d*, namely by an angle of less than 90°, as the containers are inserted into the apertures. Depending on the geometry of the arrangement of the holding tabs on the carrier, thus a collision of the holding tabs of directly adjacent apertures or receptacles can be prevented during the pivoting back or folding back of the holding tabs. In this way, the packing density of the containers on the holding structure can be further increased.

Figure 2I:
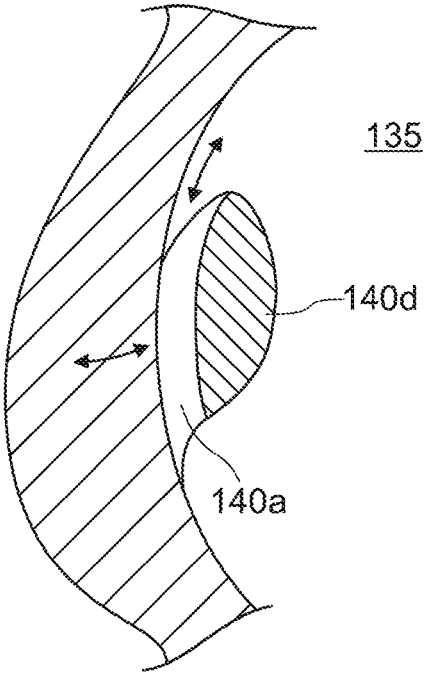
FIG. 2*i* shows a further variant of the holding tabs for a holding structure of FIG. 2*a;*

FIG. 2*i* shows a further variant of the holding tabs for a holding structure according to FIG. 2*a* in a plan view, wherein the base 140*a* is twisted, if viewed in the axial direction, which causes both a radial component and a component in the circumferential direction upon the resilient pivoting back of the holding tabs as the containers are inserted from above into the aperture or receptacle as a result of the interaction of the slanted insertion surface 140*d* with the container, as schematically indicated by the two double arrows.

Figure 2J:
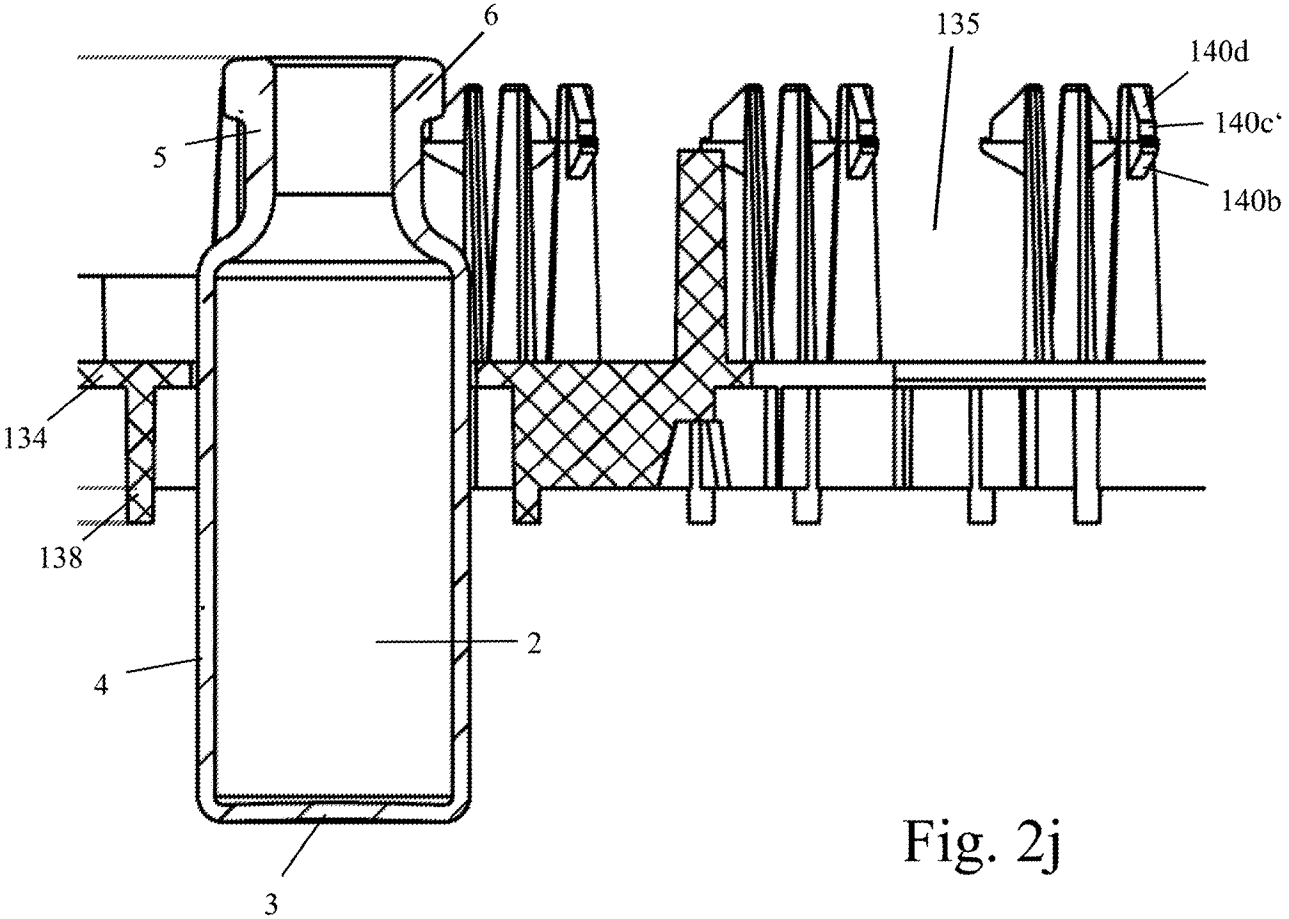
FIG. 2*j* shows a further variant of a holding structure according to the present invention.

FIG. 2*j* shows a further variant of the embodiment according to FIG. 2*f* with a modified configuration of the flag-like resilient holding tabs 140. While in the embodiment of FIG. 2*f* the transition region between the two slanted insertion surfaces 140*b* and 140*d* is flat or protrudes outward, in the embodiment of FIG. 2*j* the lower insertion surface 140*b* protrudes further into the aperture 135 than the upper slanted insertion surface 140*d*. The transition region 140*c*' extends substantially in vertical direction or is inclined relatively steeply downward. The upper rolled edge 6 of the vial 2 can rest loosely on this sloped transition region 140*c*' or on a step, which is formed by the upper side of the lower slanted insertion surface 140*b*. In any case, the resilient holding tabs 140 are configured such that a certain radial clearance exists between the front ends of the holding tabs 140 and the vials 2 held by them, so that in particular manufacturing tolerances of the vials 2 can be compensated.

Figure 1F:
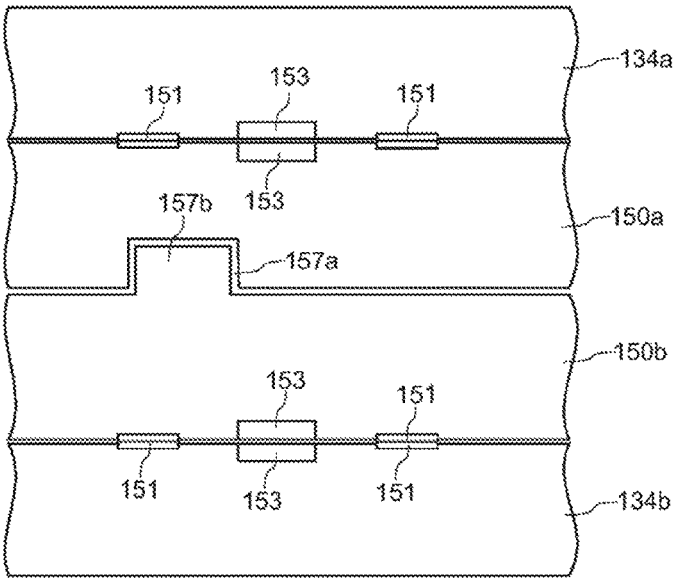
FIG. 1*f* shows a variant of the holding structure of FIG. 1*a*, which has protrusions and recesses of the members that can be removed or pivoted back, which serve to further enhance the packing density of the holding structure.

FIG. 1*f* shows in a greatly enlarged partial sectional view and in a plan view a further variant of the holding structure of FIG. 1*b*, wherein edges 150*a*, 150*b* of the planar carrier 134*a*, 134*b* can be pivoted back to further reduce the base area of the respective carrier, for example if this is to be transferred together with the containers to a processing station with constricted space, such as a freeze-dryer with limited floor space. For this purpose, the edges 150*a*, 150*b* are connected with the respective carrier via hinges 151. In particular, the hinges 151 can be formed as film hinges or snap hinges or spring hinges from a plastic material and integrally with the carrier 134.

According to FIG. 1*f* recesses 157*a* and/or protrusions 157*b* are formed on the members 150*a*, 150*b* that can be removed or pivoted back. The recesses 157*a* and/or protrusions 157*b* of the members 150*a*, 150*b* of a carrier that can be removed or pivoted back are formed corresponding to the recesses 157*a* and/or protrusions 157*b* of the members 150 of a directly adjacent planar carrier that can be removed or pivoted back so that a positive-fit between the recesses 157*a* and/or protrusions 157*b* can be established to define and stabilize the mutual positions of the carriers.

On the upper side of the carrier 134*a*, 134*b* and of the edges 150*a*, 150*b*, block-shaped stops 153 are provided at corresponding positions, which define in mutual abutment a coplanar alignment of the edges 150*a*, 150*b* and of the carrier 134 and prevent a folding-up of the edges 150*a*, 150*b*. The carriers can therefore also be placed in a transport and packaging container only at the edges (see FIG. 2*a*).

According to a further embodiment (not shown), the edges 150 can also be removed from the carrier 134. The edges 150 may of course be provided along all four longitudinal sides of the carrier 134.

Figure 1G:
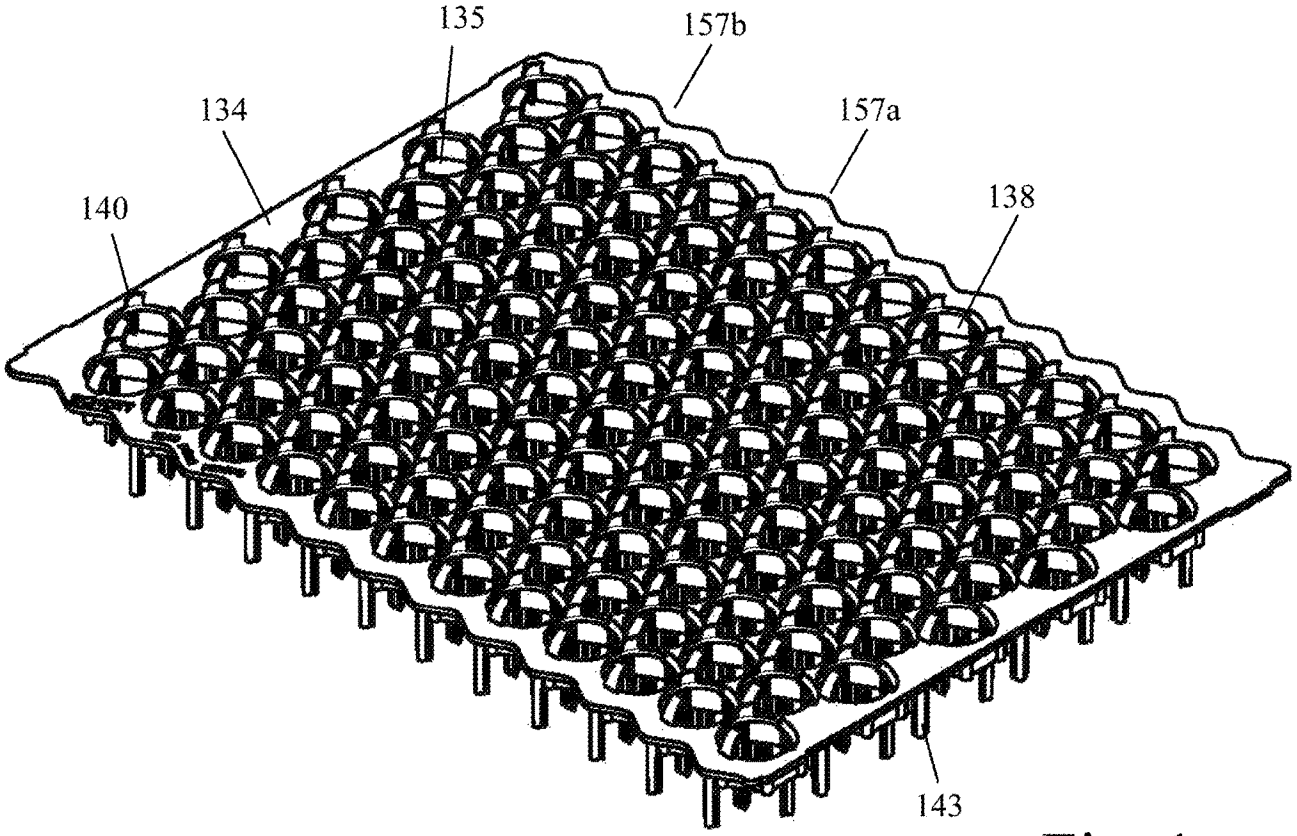
FIG. 1*g* shows a holding structure according to a further variant of FIG. 1*a* in a perspective plan view.

FIG. 1*g* shows a further variant of the above holding structure of FIG. 1*f*, wherein the aforementioned protrusions 157*a* and recesses 157*b* are formed directly on the edge of the planar carrier 134.

Figure 1H:
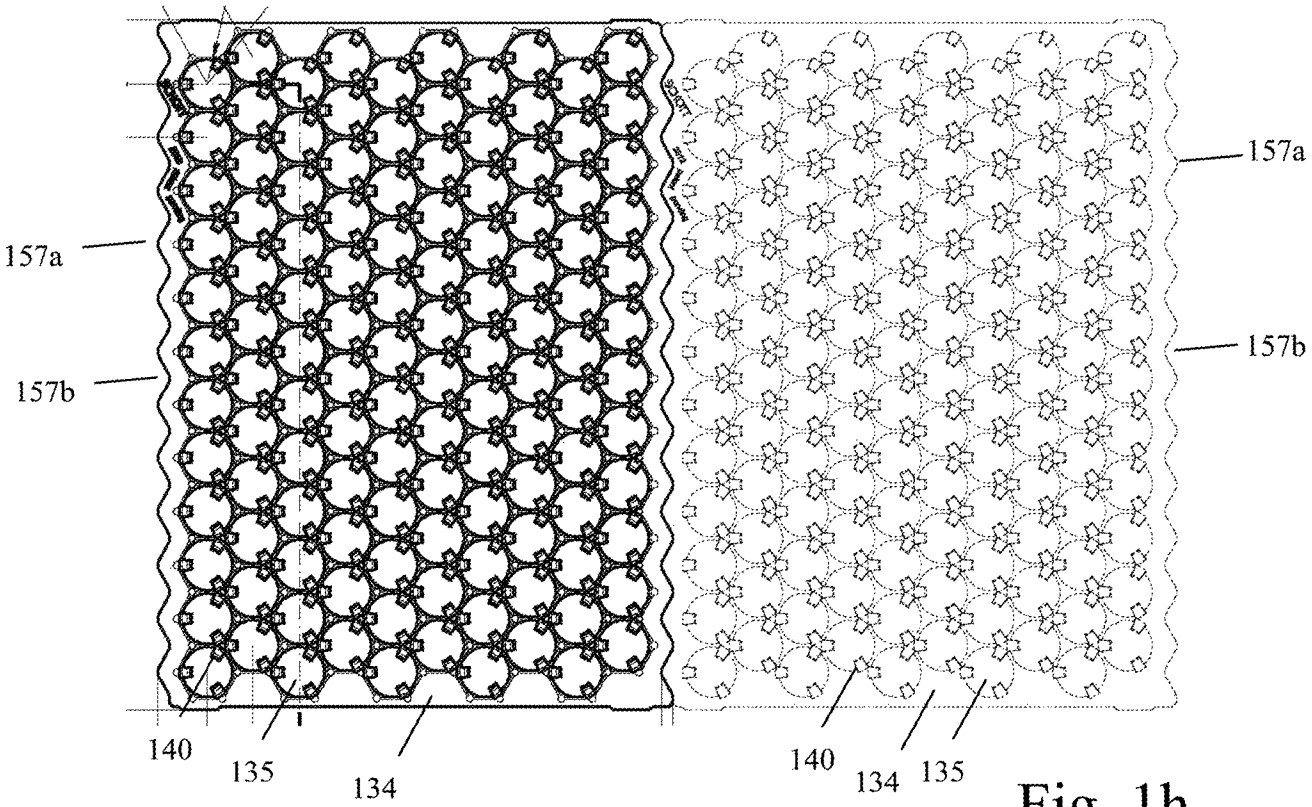
FIG. 1*h* shows the coupling of two directly adjacent holding structures of FIG. 1*a* in a schematic plan view.

FIG. 1*h* shows the cooperation of two adjacent holding structures 134 of FIG. 1*g* in a schematic plan view. The undulating protrusions 157*b* and recesses 157*a* of two adjacent carriers 134 are formed corresponding to each other so that the edges of the carriers 134 may directly engage each other by a positive-fit, which enables a mutual stabilization of the positions of the carrier 134 during the processing or handling. According to this embodiment, the carriers 134 may also be displaced further by one protrusion 157*b* along the edges and placed again in a positive-fit engagement so that the two carriers are then offset to each other by one protrusion 157*b*.

Figure 3A:
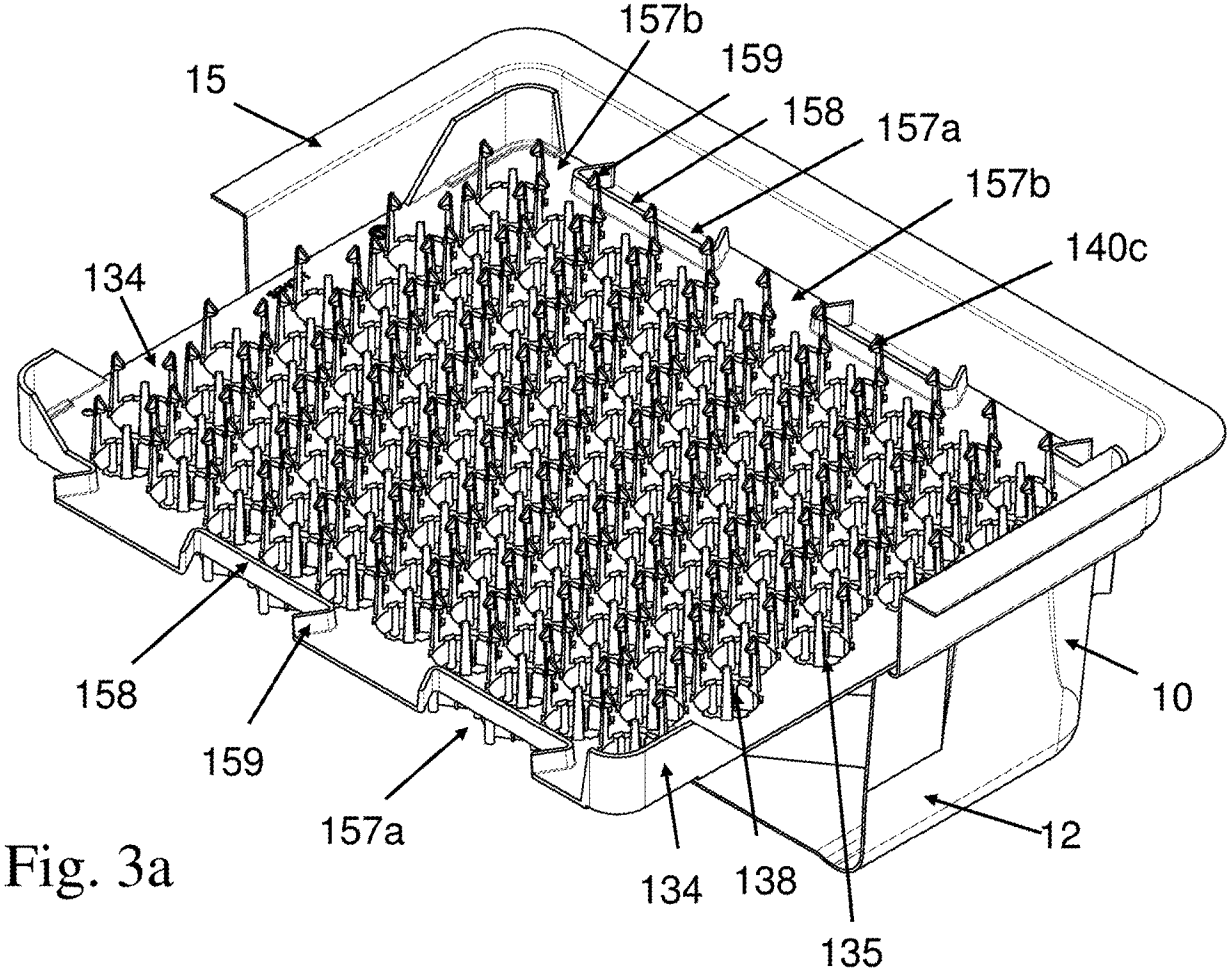
FIG. 3*a* shows a holding structure according to a further embodiment of the present invention in a perspective plan view.

FIG. 3*a* shows a holding structure according to a further embodiment of the present invention in a perspective plan view that may also be independent from the other embodiments. According to FIG. 3*a* a plurality of protrusions 157*b* and recesses 157*a* are formed along the two longitudinal sides of the holding plate 134 alternately and at regular intervals to each other. If viewed in a plan view, these comprise a base area basically of a triangular or polyhedral shape and are configured to correspond to each other, so that they can be latched directly to one another.

Figure 3B:
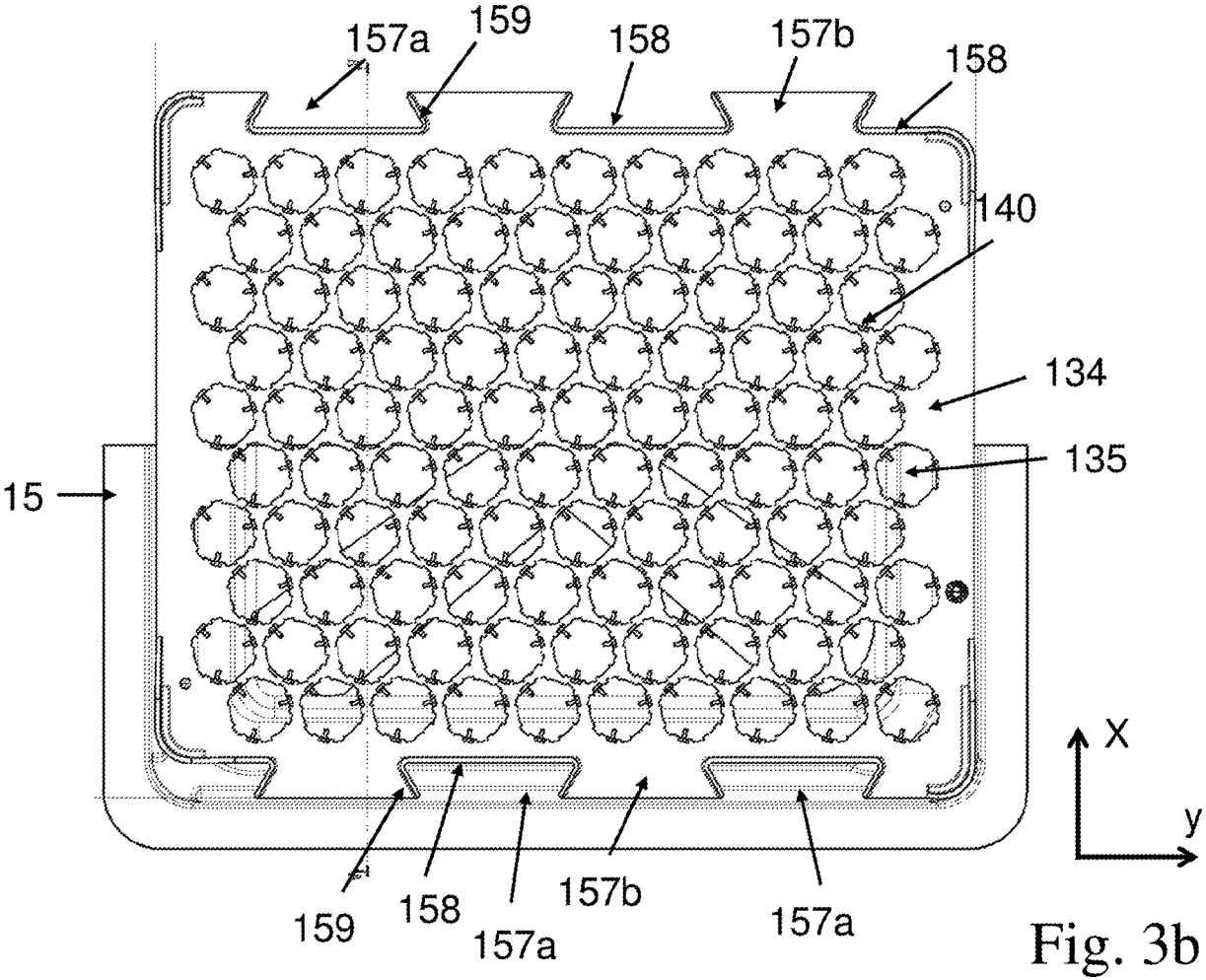
FIG. 3*b* shows the holding structure of FIG. 3*a* in a plan view.
Figure 3C:
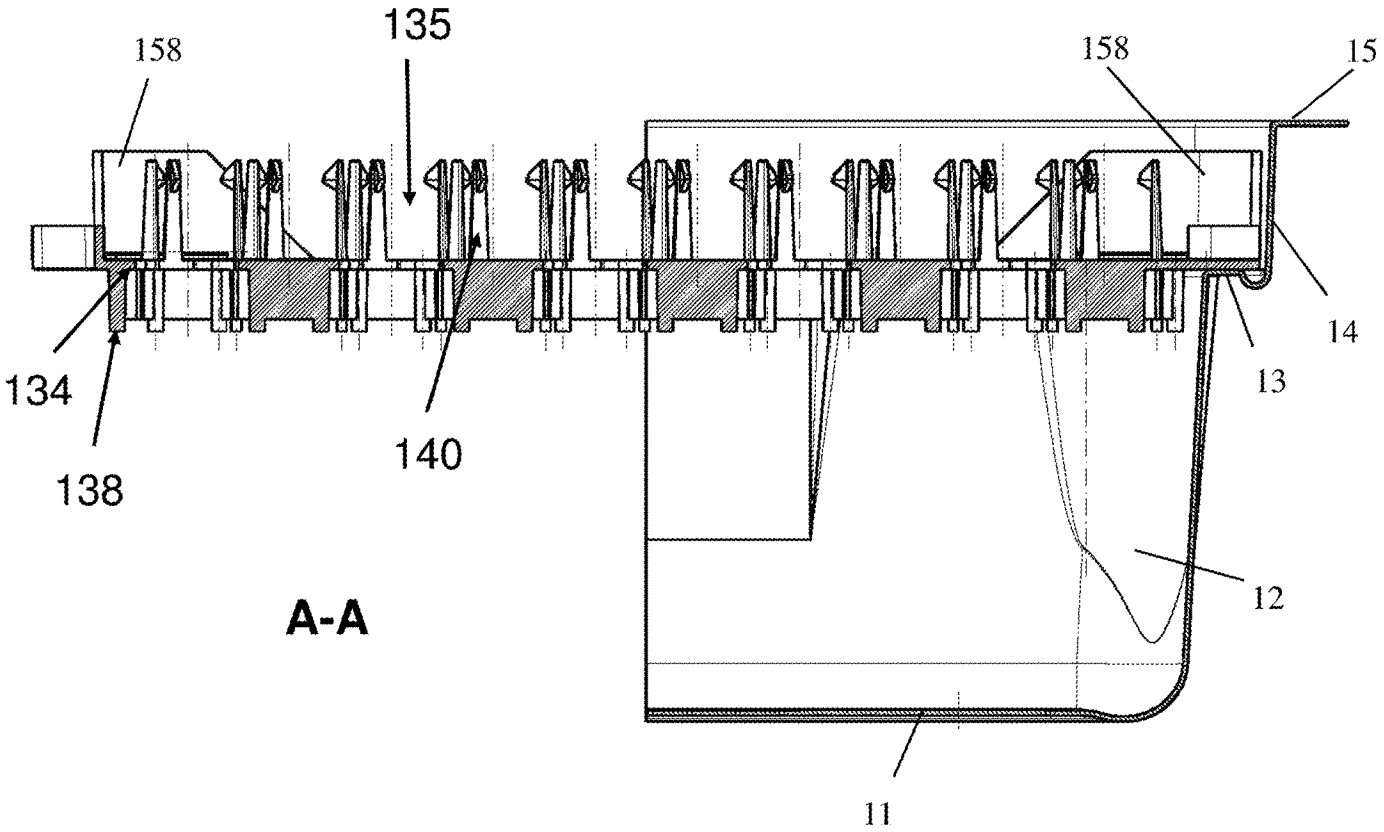
FIG. 3*c* shows a partial cross-section of the holding structure of FIG. 3*b;*

As can be concluded from the plan view of FIG. 3*b*, two holding structures can be latched together so that these are aligned in the transverse direction (x). For this purpose, the recess 157*a* is formed only half in the lower right-hand corner region of the holding plate 134. In the opposite upper right-hand corner portion of the holding plate 134, however, the corresponding protrusion 157*b* is also formed only half and passes over into a rounded corner of the hold plate 134.

Due to the aforementioned configuration of the protrusions 157*b* and recesses 157*a*, however, two holding structures may in principle also be latched with each other so that these are offset to each other in the transverse direction (x), i.e. so that these are not aligned.

For latching two holding structures, one of the holding structures may be lifted by means of a lifting device in a direction perpendicular to the plane of the holding plate 134. Subsequently, the two holding structures are moved towards each other until finally, if viewed in a plan view, the protrusions 157*b* and recesses 157*a* of the adjacent holding structures overlap each other. By a subsequent lowering of the holding plate 134 perpendicular to the plane of the holding plate 134, finally, the protrusions 157*b* and recesses 157*a* engage with each other in a positive-fit manner. This procedure may be performed manually but also fully or semi-automatically. Here, the holding plates 134 may be pre-loaded with vials. In general, however, the loading of the holding plates 134 with vials may be performed only after the holding plates 134 have been coupled with each other.

Due to the above configuration of the protrusions 157*b* and recesses 157*a* overall a latching effect in the manner of a dovetail coupling is implemented. As will be readily apparent to the person skilled in the art when studying the above description, in general any other positive-locking or frictional coupling techniques may be used for a temporary, releasable coupling of two holding structures.

As can be concluded from the perspective plan view of FIG. 3*a*, side walls 158, 159 are formed at least in sections along the edges of the protrusions 157*b* and recesses 157*a*, which protrude perpendicularly from the surface of the holding plate 134. These side walls 158, 159 follow the contour of the associated recess 157*a* or of the associated protrusion 157*b* and act as a stop and guiding surface, which prevents that the holding plates 134 slide or slip one above the other. More specifically, according to FIG. 3*b* a side wall 158 is formed along the front side of the protrusions 157*b* on the upper edge of the holding plate 134, which is followed by a side wall 159 in the region of the adjacent recesses 157*a* but which do not extend over the entire depth of the recesses (in x-direction). At the opposite lower edge of the holding plate 134, however, the side walls 158 are formed along the base of the recesses 157*a*, while the angled side walls 159*a* extend along the angled sides of the recesses 157*a* but not over their entire depth (in the x-direction).

Figure 3D:
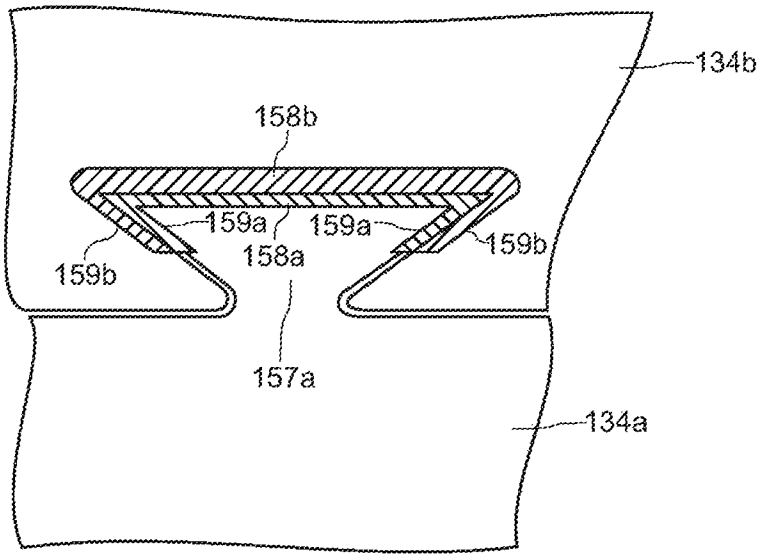
FIG. 3*d* shows the latching and engagement of protrusions and recesses on the edges of two holding structures of FIG. 3*a* in a greatly enlarged partial plan view.
Figure 3F:
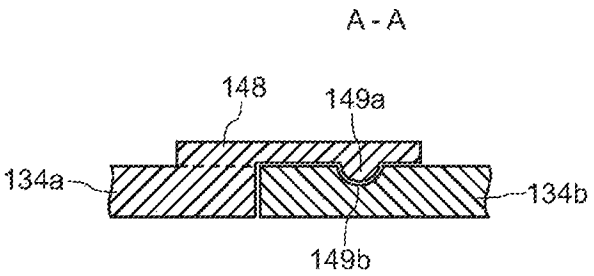
FIG. 3*f* shows a partial cross-section along A-A of FIG. 3*e.*

As shown in the greatly enlarged partial plan view of FIG. 3*d* in the latched state the side walls 158*a* of the lower plate 134*a* abut directly the side walls 158*b* of the upper holding plate 134*b*. Furthermore, also the angled side walls 159*b* of the upper holding plate 134*b* abut directly the angled side walls 159*a* of the lower holding plate 134*a*.

Figure 3E:
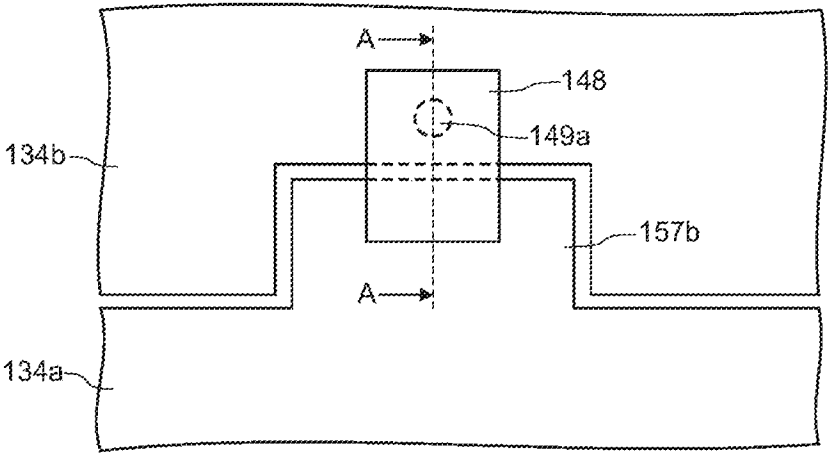
FIG. 3*e* shows the coupling of two holding structures of FIG. 3*a* according to a further embodiment in a greatly enlarged partial plan view.

FIG. 3*e* shows as a further example of a form-fitting coupling of two holding plates 134*a*, 134*b* according to a further embodiment in a greatly enlarged partial plan view. According to FIG. 3*e* a resilient holding tab 148 protrudes perpendicularly from the rectangular protrusions 157*b* of the lower holding plate 134*a* towards the associated recess of the upper holding plate 134*b*. As can be concluded from the schematic partial sectional view along line A-A of FIG. 3*d*, the resilient tab protrudes from the plane defined by the holding plates 134*a*, 134*b*, but extends in parallel with them. At the front end of the resilient tab 148, a spherical protrusion 149*a* is formed, which engages in a corresponding receptacle 149*b* on the upper side of the upper holding plate 134*b*. For a coupling with each other the holding plates 134*a*, 134*b* may be pushed towards each other, until the front end of the resilient tab 148 with the protrusion 149*a* finally gets in contact with the upper side of the upper holding plate 134*b*. When the two holding plates 134*a*, 134*b* approach each other further, finally the resilient tab 148 is bent upwards so that the protrusion 149*a* slides along the surface of the upper holding plate 134*b*, until it finally enters the region of the receptacle 149*b* and is pressed into the latter due to the returning force of the resilient tab 148. The resiliency of the tabs 148 and the design of the form-fitting structures 149*a*, 149*b* define the strength of the releasable coupling between the two holding plates 134*a*, 134*b* in a simple manner. For preventing a sliding of the two holding plates 134*a*, 134*b* one above the other, also according to this embodiment stop and guiding surfaces may be provided, particularly in as side walls protruding perpendicularly from the upper side of the holding plates 134*a*, 134*b*, as described above with reference to FIG. 3*a*. Particularly, in the embodiment of FIG. 3*d* such side walls would have to be provided laterally adjacent to the resilient tabs 148.

As will be readily apparent to the person skilled in the art when studying the above description, in general the aforementioned aspect of the form-fitting or frictional coupling between directly adjacent holding structures is independent of the specific design of the holding of the vials at such holding structures, so that this aspect in principle may be an independent aspect of the present invention independently from the specific design of the holding of the vials at such holding structures.

The holding force exerted by each of the holding means on the containers is sufficient to hold the containers reliably on the holding structure. In particular, the holding force exerted is greater than the weight of the containers, if necessary together with the content and sealing plugs. Thus, a reliable holding of the containers on the holding structure is ensured. At the same time, the containers may be displaced in the apertures or receptacles of the holding structure without too much effort, in particular these may be displaced in axial direction or rotated.

Of course, the holding structure (the carrier) in the sense of the present invention may also be formed of a thermoplastic, thermosetting or elastomeric plastic material, wherein at least portions of the holding structure or of the carrier are provided with a coating reducing friction to facilitate the insertion and removal of the containers.

According to a further embodiment, the holding structure and/or the transport container, or portions thereof, may be formed of fiber reinforced plastics or of a plastic to which ceramics or metals are added in order to increase its thermal conductivity. As is known, fiber reinforced plastics have a higher thermal conductivity of up to 0.9 W/(m K) if including carbon fibers. If ceramics or metals are added to the plastics, the thermal conductivity is further increased. Thus so-called heat-conductive plastics are created. Thus, a thermal conductivity of 20 W/(K m) is accomplished.

As will be readily apparent to the person skilled in the art upon reading the above description, the various aspects and features of the embodiments described above may be combined in any manner with one another, resulting in numerous further embodiments and modifications. As will be readily apparent to the person skilled in the art upon reading the above description, all such further embodiments and modifications shall be comprised by the present invention, as long as these do not depart from the general solution and scope of the present invention, as defined in the appended claims.

What is claimed is:

1. A holding structure for concurrently holding a plurality of containers for substances for medical, pharmaceutical or cosmetic applications, comprising a planar and rectangular carrier having a plurality of apertures or receptacles into which the containers can be inserted; and holding devices for holding the containers in the apertures or receptacles of the carrier;

wherein the holding structure has a longitudinal direction and a transverse direction, wherein the holding structure can be coupled with a directly adjacent holding structure of the same configuration so that the holding structure and the directly adjacent holding structure of the same configuration are substantially immovable relative to each other in the longitudinal direction and/or in the transverse direction;

wherein the holding devices are configured so that the containers rest loosely with portions thereof on the holding devices, so that the containers can be removed from the apertures or receptacles in an upward direction without resistance, wherein the apertures or receptacles are delimited at least partially by a respective side wall on a bottom side opposite to an upper side, and wherein the lengths of the side walls are matched to the lengths of the containers to be supported in such a manner that a collision of containers in directly adjacent apertures or receptacles is prevented by the side walls, and so that bottoms or bottom ends of the containers protrude from bottom ends of the side walls, when the containers are accommodated in the apertures or receptacles, so that the bottoms or bottom ends of the containers are freely accessible from the bottom side of the carrier for processing while the containers are held on the carrier in the apertures or receptacles.

2. The holding structure according to claim 1, being configured to be coupled with the directly adjacent holding structure of the same configuration temporarily and releasably by devices of form-fitting coupling structures or frictional coupling structures.

3. The holding structure according to claim 2, wherein the form-fitting coupling structures or frictional coupling structures are configured such that a plurality of holding structures of the same configuration can be arranged in a row one behind one another or next to each other or so that they are offset in the transverse direction and coupled with each other so that they are not aligned.

4. The holding structure according to claim 1, wherein at least one first positive-locking structure is formed on an edge of the holding structure and at least one second positive-locking structure is formed on an opposite edge of the directly adjacent holding structure of the same configuration, where the first positive-locking structure and the second positive-locking structure are formed corresponding to each other and can be transferred to a positive-locking engagement.

5. The holding structure according to claim 4, wherein the at least one first positive-locking structure of the holding structure is formed as a respective protrusion or as a respective recess along the edge of the holding structure and the at least one second positive-locking structure of the directly adjacent holding structure of the same configuration is formed as a respective recess or as a respective protrusion along the opposite edge of the directly adjacent holding structure of the same configuration, wherein the protrusion and the recess are formed directly corresponding to each other.

6. The holding structure according to claim 5, wherein the protrusion and the recess do not protrude substantially out of a plane defined by the holding structure and by the directly adjacent holding structure of the same configuration, respectively.

7. The holding structure according to claim 6, wherein base areas of the protrusion and of the recess, if viewed in a plan view, are different from a rectangular shape.

8. The holding structure according to claim 5, wherein side walls, which protrude perpendicularly from a surface of the holding structure and from a surface of the directly adjacent holding structure of the same configuration, are formed along edges of the protrusion and of the recess of the holding structure and of the directly adjacent holding structure of the same configuration at least in sections.

9. The holding structure according to claim 5, wherein the protrusion and the recess are formed as an undulating protrusion and recess, respectively, if viewed in a plan view.

10. The holding structure according to claim 4, wherein the at least one first positive-locking structure of the holding structure comprises a resilient tab with a locking protrusion formed thereon or with a locking recess formed thereon and the at least one second positive-locking structure of the directly adjacent holding structure of the same configuration comprises a receptacle corresponding to the locking protrusion or a protrusion corresponding to the locking recess.

11. The holding structure according to claim 1, wherein edges of the planar carrier are formed as members that can be removed or pivoted back to reduce the base area of the planar carrier.

12. The holding structure according to claim 11, wherein the members that can be pivoted back are connected to the carrier via film hinges or snap hinges or spring hinges, which are integrally formed with the carrier.

13. The holding structure according to claim 11, wherein block-shaped stops are provided at corresponding positions on the upper side of the planar carrier and of the members that can be removed or pivoted back, which define in mutual abutment a coplanar alignment of the members that can be removed or pivoted back and of the planar carrier and prevent a folding-up of the members that can be removed or pivoted back.

14. The holding structure according to claim 11, wherein the holding devices comprise at least two holding tabs, which are provided at the edge of a respective aperture or receptacle and protrude from an upper side of the carrier for holding the respective container, wherein the holding tabs are configured such that these are resiliently pivoted or folded back as the containers are inserted into the apertures or receptacles and wherein the holding tabs are matched to the containers such that these are held by the holding tabs with a radial clearance.

15. The holding structure according to claim 14, wherein the holding tabs are resilient holding tabs.

16. The holding structure according to claim 14, wherein the holding tabs are preloaded resiliently towards a holding position by means of a resilient return member.

17. The holding structure of claim 14, wherein the holding tabs are matched to the containers such that the containers rest loosely on upper sides of the holding tabs with an expanded rim, which is formed at an upper end of the containers.

18. The holding structure of claim 14, wherein the holding tabs embrace an expanded rim, which is formed at an upper end of the containers, so that the containers are held by the holding tabs with a radial clearance or with radial and axial clearance.

19. The holding structure of claim 14, wherein the holding tabs are disposed and distributed on the upper side of the carrier such that these do not contact each other directly as they are pivoted or folded back and that they do not obstruct a directly adjacent aperture or receptacle.

20. The holding structure of claim 14, wherein slanted insertion surfaces are formed at upper ends of the holding tabs each of which passing into a holding nose protruding radially inward for holding the containers.

21. The holding structure of claim 1, wherein the side walls are disposed distributed in a regular hexagonal arrangement on the lower side of the carrier, wherein the side walls of a respective aperture or receptacle are each circumferential and form a hexagonal honeycomb structure on the lower side of the carrier.

22. The holding structure according to claim 1, wherein the side walls are disposed distributed in a regular hexagonal arrangement on the lower side of the carrier, wherein the side walls of a respective aperture or receptacle are each circular in shape and circumferential.

23. The holding structure of claim 14, wherein the holding tabs are integrally formed with the carrier and protrude arcuately from the upper side of the carrier.

24. The holding structure of claim 23, wherein the holding tabs of a respective aperture or receptacle respectively form a three-point bearing for holding the containers in the respective apertures or receptacles of the carrier.

25. A transport or packaging container for a plurality of containers for substances for cosmetic, medical or pharmaceutical applications, wherein the transport or packaging container is box-shaped, and a holding structure for concurrently holding the plurality of containers where the holding structure is in the box-shaped transport or packaging container to hold the plurality of containers, the holding structure comprising:

a planar and rectangular carrier having a plurality of apertures or receptacles into which the containers can be inserted; and holding devices for holding the containers in the apertures or receptacles of the carrier;

wherein the holding structure has a longitudinal direction and a transverse direction, wherein the holding structure, if taken out of the transport or packaging container, can be coupled with a directly adjacent holding structure of the same configuration so that the holding structure and the directly adjacent holding structure of the same configuration are substantially immovable relative to each other in the longitudinal direction and/or in the transverse direction, wherein the holding devices are configured so that the containers rest loosely with portions thereof on the holding devices, and so that the containers can be removed from the apertures or receptacles in an upward direction without resistance, wherein the apertures or receptacles are delimited at least partially by a respective side wall on a bottom side opposite to an upper side, and wherein the lengths of the side walls are matched to the lengths of the containers to be supported in such a manner that a collision of containers in directly adjacent apertures or receptacles is prevented by the side walls, and so that bottoms or bottom ends of the containers protrude from bottom ends of the side walls, when the containers are accommodated in the apertures or receptacles, so that the bottoms or bottom ends of the containers are freely accessible from the bottom side of the carrier for processing while the containers are held on the carrier in the apertures or receptacles.

26. A holding structure comprising a plurality of containers for substances for medical, pharmaceutical or cosmetic applications concurrently held at the holding structure, the holding structure comprising a planar and rectangular carrier having a plurality of apertures or receptacles into which the containers can be inserted; and holding devices for holding the containers in the apertures or receptacles of the carrier;

wherein the holding structure has a longitudinal direction and a transverse direction, and wherein the holding structure can be coupled with a directly adjacent holding structure of the same configuration so that the holding structure and the directly adjacent holding structure of the same configuration are substantially immovable relative to each other in the longitudinal direction and/or in the transverse direction, wherein the containers rest loosely with portions thereof on the holding devices so that the containers can be removed from the apertures or receptacles in an upward direction without resistance, wherein the apertures or receptacles are delimited at least partially by a respective side wall on a bottom side opposite to an upper side, wherein the lengths of the side walls are matched to the lengths of the containers to be supported in such a manner that a collision of containers accommodated in directly adjacent apertures or receptacles is prevented by the side walls, and wherein bottoms or bottom ends of the containers protrude from bottom ends of the side walls, so that the bottoms or bottom ends of the containers are freely accessible from the bottom side of the carrier for processing.

* * * * *